US008882375B2

(12) United States Patent
Katahira

(10) Patent No.: US 8,882,375 B2
(45) Date of Patent: Nov. 11, 2014

(54) PRINT APPARATUS

(75) Inventor: Yasuhiro Katahira, Tokyo (JP)

(73) Assignee: Oki Data Corporation, Tokyo (JP)

( * ) Notice: Subject to any disclaimer, the term of this patent is extended or adjusted under 35 U.S.C. 154(b) by 54 days.

(21) Appl. No.: 13/330,796

(22) Filed: Dec. 20, 2011

(65) Prior Publication Data

US 2012/0163892 A1 Jun. 28, 2012

(30) Foreign Application Priority Data

Dec. 22, 2010 (JP) ..... 2010-285444

(51) Int. Cl.
*B41J 11/26* (2006.01)
*B41J 11/00* (2006.01)
*B41J 11/42* (2006.01)

(52) U.S. Cl.
CPC ..... *B41J 11/42* (2013.01)
USPC ..... 400/616.3; 400/616

(58) Field of Classification Search
CPC ..... B41J 11/26; B41J 11/34
USPC ..... 271/10.1; 400/283, 616, 616.3
See application file for complete search history.

(56) References Cited

U.S. PATENT DOCUMENTS

| | | | | |
|---|---|---|---|---|
| 5,490,734 | A * | 2/1996 | Maruyama et al. | 400/582 |
| 5,544,966 | A * | 8/1996 | Pagliaro et al. | 400/616 |
| 6,739,683 | B2 * | 5/2004 | Shimomura et al. | 347/8 |
| 7,066,670 | B2 * | 6/2006 | Bakken et al. | 400/616 |
| RE40,775 | E * | 6/2009 | Arquilevich et al. | 358/1.8 |
| 7,694,965 | B2 * | 4/2010 | Bruhn et al. | 271/275 |

FOREIGN PATENT DOCUMENTS

JP 2005-343643 A 12/2005

* cited by examiner

*Primary Examiner* — Matthew G Marin
*Assistant Examiner* — John M Royston
(74) *Attorney, Agent, or Firm* — Marvin A. Motsenbocker; Mots Law, PLLC

(57) ABSTRACT

A print apparatus includes a print-medium sender configured to send out a print medium, a print-medium transportation unit disposed downstream of the print-medium sender in a print-medium transportation direction, and configured to transport the print medium, a print unit disposed between the print-medium sender and the print-medium transportation unit, and configured to perform printing on the print medium while moving in a direction perpendicular to the print-medium transportation direction, and a transport-amount correction controller configured to correct the amount of transportation of the print medium by the print-medium sender or the print-medium transportation unit in accordance with the position of an end of the print medium.

23 Claims, 19 Drawing Sheets

FIG. 7

| HEAD-GAP SETUP INFORMATION | FEED CORRECTION AMOUNT | CORRECTION START - ENDING POINT |
|---|---|---|
| 1 | PLUS CORRECTION OF 1/360 INCHES FOR EVERY 0.3-INCH FEED | AFTER SHEET FEED - ROLLERS IN PULL-UP-ROLLER ASSEMBLY |
| 2 | PLUS CORRECTION OF 1/360 INCHES FOR EVERY 0.275-INCH FEED | AFTER SHEET FEED - ROLLERS IN PULL-UP-ROLLER ASSEMBLY |
| 3 - 4 | PLUS CORRECTION OF 1/360 INCHES FOR EVERY 0.25-INCH FEED | AFTER SHEET FEED - ROLLERS IN PULL-UP-ROLLER ASSEMBLY |
| 5 - 8 | PLUS CORRECTION OF 1/360 INCHES FOR EVERY 0.225-INCH FEED | AFTER SHEET FEED - ROLLERS IN PULL-UP-ROLLER ASSEMBLY |

FIG. 9

| HEAD-GAP SETUP INFORMATION | PRINT-SPEED REDUCTION RATIO |
|---|---|
| 1 | 95% |
| 2 | 90% |
| 3 - 4 | 80% |
| 5 - 8 | 70% |

FIG. 14

| HEAD-GAP SETUP INFORMATION | FEED CORRECTION AMOUNT | CORRECTION START - ENDING POINT |
|---|---|---|
| 1 | MINUS CORRECTION OF 1 / 360 INCHES FOR EVERY 0.3-INCH FEED | AFTER 25 mm AWAY FROM TRACTOR - LEAF SPRING |
| 2 | MINUS CORRECTION OF 1 / 360 INCHES FOR EVERY 0.275-INCH FEED | AFTER 25 mm AWAY FROM TRACTOR - LEAF SPRING |
| 3 - 4 | MINUS CORRECTION OF 1 / 360 INCHES FOR EVERY 0.25-INCH FEED | AFTER 25 mm AWAY FROM TRACTOR - LEAF SPRING |
| 5 - 8 | MINUS CORRECTION OF 1 / 360 INCHES FOR EVERY 0.225-INCH FEED | AFTER 25 mm AWAY FROM TRACTOR - LEAF SPRING |

FIG. 15

| HEAD-GAP SETUP INFORMATION | FEED CORRECTION AMOUNT | CORRECTION START - ENDING POINT |
|---|---|---|
| 1 | MINUS CORRECTION OF 1/360 INCHES FOR EVERY 0.25-INCH FEED | AFTER LEAF SPRING COMES OFF - PULL-UP ROLLER |
| 2 | MINUS CORRECTION OF 1/360 INCHES FOR EVERY 0.2-INCH FEED | AFTER LEAF SPRING COMES OFF - PULL-UP ROLLER |
| 3 - 4 | MINUS CORRECTION OF 1/360 INCHES FOR EVERY 0.175-INCH FEED | AFTER LEAF SPRING COMES OFF - PULL-UP ROLLER |
| 5 - 8 | MINUS CORRECTION OF 1/360 INCHES FOR EVERY 0.15-INCH FEED | AFTER LEAF SPRING COMES OFF - PULL-UP ROLLER |

FIG. 17A

| HEAD-GAP SETUP INFORMATION | PRINT-SPEED REDUCTION RATIO |
|---|---|
| 1 | 75% |
| 2 | 70% |
| 3 - 4 | 60% |
| 5 - 8 | 50% |

FIG. 17B

| HEAD-GAP SETUP INFORMATION | PRINT-SPEED REDUCTION RATIO |
|---|---|
| 1 | 95% |
| 2 | 90% |
| 3 - 4 | 80% |
| 5 - 8 | 70% |

PRINT APPARATUS

CROSS REFERENCE TO RELATED APPLICATIONS

This application claims priority based on 35 USC 119 from prior Japanese Patent Application No. 2010-285444 filed on Dec. 22, 2010, entitled "PRINT APPARATUS", the entire contents of which are incorporated herein by reference.

BACKGROUND OF THE INVENTION

1. Field of the Invention

The present disclosure relates to a print apparatus that includes a sheet transportation mechanism to transport sheets.

2. Description of Related Art

A print apparatus of the related art includes a print head that performs printing, a platen that is disposed to face the print head, a carriage that enables the print head to move in the lengthwise direction of the platen, a tractor that sends a sheet as a print medium, and a pull-up roller that draws in and transports the printed sheet. In the print apparatus, the tractor sends the sheet into the interstice between the print head and the platen, the pull-up roller pulls up and transports the sheet, and the print head performs printing on the sheet (for example, In the above-described technique of the related art, however, sheets are transported with such low precision that the print quality may be degraded.

SUMMARY OF THE INVENTION

An embodiment of the invention aim to enhance transportation precision of sheets and thereby to improve the print quality.

An aspect of the invention is a print apparatus including: a print-medium sender configured to send out a print medium; a print-medium transportation unit disposed downstream of the print-medium sender in a print-medium transportation direction, and configured to transport the print medium; a print unit disposed between the print-medium sender and the print-medium transportation unit, and configured to perform printing on the print medium while moving in a direction perpendicular to the print-medium transportation direction; and a transport-amount correction controller configured to correct the amount of transportation of the print medium by the print-medium sender or the print-medium transportation unit in accordance with the position of an end of the print medium.

BRIEF DESCRIPTION OF THE DRAWINGS

FIG. 7 is a diagram showing a feed-amount correction table according to the first embodiment.

FIG. 9 is a diagram showing a print-speed reduction-ratio table according to the first embodiment.

FIG. 14 is a diagram showing a feed-amount correction table according to the second embodiment.

FIG. 15 is a diagram showing a feed-amount correction table according to the second embodiment.

FIGS. 17A and 17B are diagrams of print-speed reduction-ratio tables according to the second embodiment.

DETAILED DESCRIPTION OF EMBODIMENTS

Figure 1:
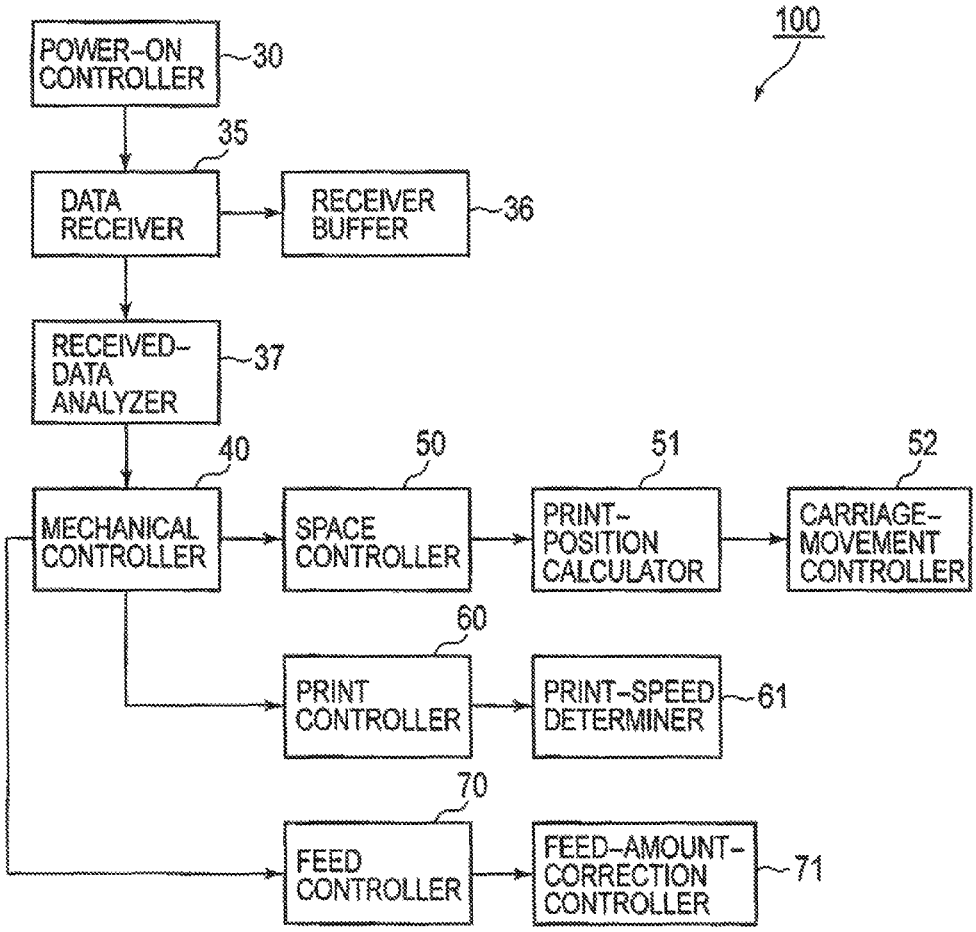
FIG. 1 is a block diagram illustrating a configuration of a control system for a print apparatus according to a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Print apparatuses according to embodiments of the invention are described below by referring to the drawings.

First Embodiment

Figure 2:
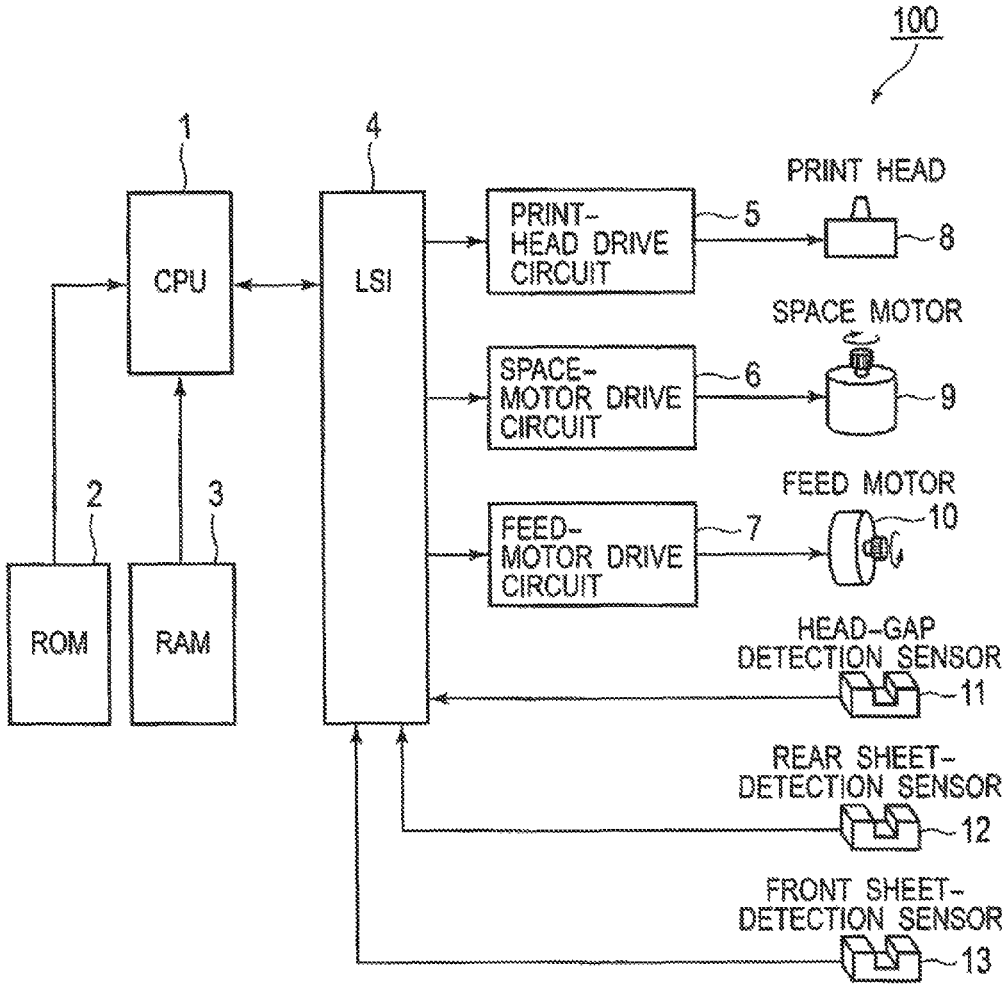
FIG. 2 is a block diagram illustrating a configuration of the print apparatus according to the first embodiment
Figure 3:
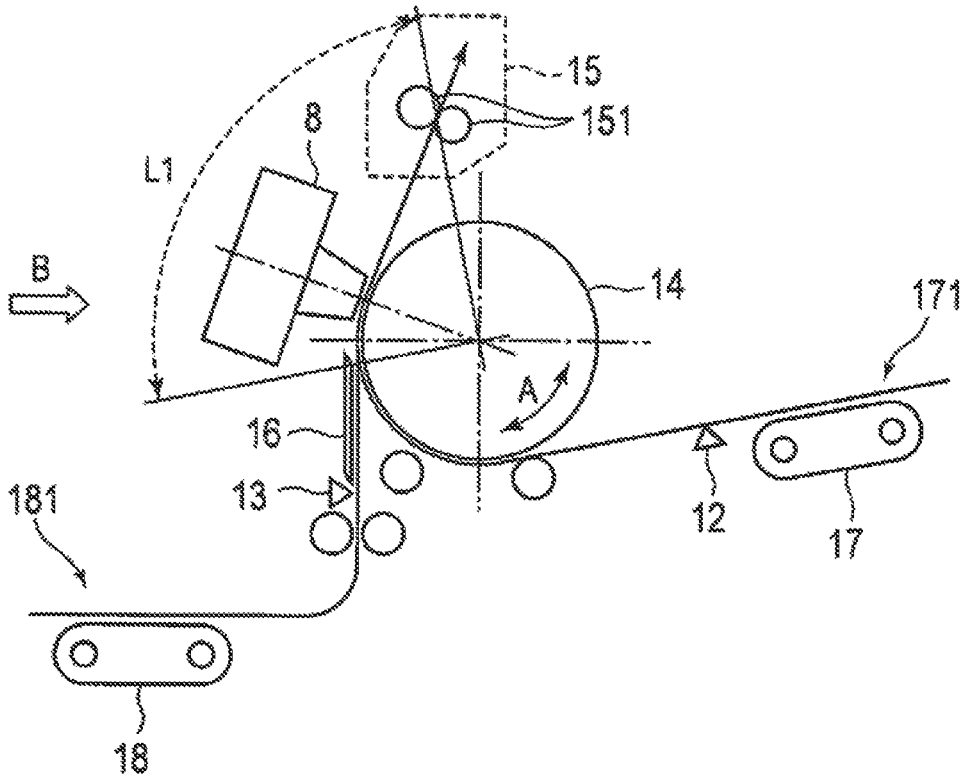
FIG. 3 is a schematic side view showing a structure of a sheet transportation mechanism of the print apparatus according to the first embodiment.

FIG. 1 is a block diagram illustrating a configuration of a control system for a print apparatus according to a first embodiment; FIG. 2 is a block diagram illustrating a configuration of the print apparatus according to the first embodiment; and FIG. 3 is a schematic side view showing a structure of a sheet transportation mechanism of the print apparatus according to the first embodiment.

FIG. 2 shows the configuration of print apparatus (hereinafter, simply referred to as "printer") 100, specifically a dot impact printer. Printer 100 includes central processing unit (CPU) 1, read only memory (ROM) 2, random access memory (RAM) 3, large scale integration (LSI) 4, print-head drive circuit 5, space-motor drive circuit 6, feed-motor drive circuit 7, print head 8, space motor 9, feed motor 10, head-gap detection sensor 11, rear sheet-detection sensor 12, and front sheet-detection sensor 13.

CPU 1 is a central processing unit to control the operations of printer 100. CPU 1 is connected to ROM 2, RAM 3, and LSI 4. ROM 2 is a non-volatile memory that stores control programs (software) to control printer 100. RAM 3 is a volatile memory, and LSI 4 is an integrated circuit.

ROM 2 stores program commands to control printer 100, data that are accessed when such program commands are executed, data used for the correction in various kinds of operations such as the print-speed correction and the feed-amount correction, CG data, and the like. RAM 3 stores control information to control printer 100 on the basis of the program commands, data sent from an unillustrated host computer, and the like.

LSI 4 is an integrated circuit that includes an I/O (Input/Output) signal controller to control printer 100. LSI 4 is connected to print-head drive circuit 5, space-motor drive circuit 6, feed-motor drive circuit 7, head-gap detection sensor 11, rear sheet-detection sensor 12, and front sheet-detection sensor 13. Print-head drive circuit 5 is a circuit to drive print head 8. Space-motor drive circuit 6 is a circuit to drive space motor 9. Feed-motor drive circuit 7 is a circuit to drive feed motor 10. Print head 8, which serves as a print unit, is a unit to perform printing by using dot impact pins that print head 8 is equipped with. To perform printing, an ink ribbon and a sheet as a print medium are provided in advance. While print head 8 is executing printing, the dot impact pins hit the sheet over the ink ribbon, and thereby the ink is transferred onto the sheet.

Space motor 9 is a motor to move print head 8 in directions that are perpendicular to the sheet transportation direction (i.e., linefeed direction) while printing is being executed. Hereinafter, the directions in which space motor 9 moves print head 8 are referred to as the "horizontal directions." To move back and forth print head 8, the rotary motion of space motor 9 is transformed into a linear, reciprocating motion by means of pulleys and a timing belt. Feed motor 10 is a motor to move the sheet in directions that are perpendicular to the directions in which print head 8 moves. Hereinafter, the directions in which the sheet is moved by feed motor 10 are referred to as the "vertical directions." Thus, feed motor 10 performs the linefeed operation (hereinafter, simply referred to as the "feed operation").

Head-gap detection sensor 11 is a sensor mounted on a head-gap switch lever, which adjusts the distance between print head 8 and the platen in accordance with the thickness of the sheet. Head-gap detection sensor 11 detects the head-gap position, that is, the distance between print head 8 and the platen. The head-gap position detected by head-gap detection sensor 11 is read out as head-gap setup information by CPU 1.

Rear sheet-detection sensor 12 is a sensor that detects the top end (leading end) and the bottom end (trailing end) of the sheet if the sheet is fed through a rear sheet-feed route described in detail later. Front sheet-detection sensor 13 is a sensor that detects the top end and the bottom end of the sheet if the sheet is fed through a front sheet-feed route described in detail later.

In printer 100 with the above-described configuration, CPU 1 controls the overall operations of printer 100. Specifically, CPU 1 controls the revolution speed of space motor 9, and thereby controls the speed of the printing performed by print head 8. CPU 1 also controls the revolution amount of feed motor 10, and thereby controls the feed amount, that is, the amount by which the sheet is transported. In addition, CPU 1 pinpoints the positions of the top end and the bottom end of the sheet on the basis of: the detection of the top end and the bottom end of the sheet by rear sheet-detection sensor 12 or front sheet-detection sensor 13, and the amount of feeding the sheet by feed motor 10. CPU 1 stores the information on the positions in RAM 3.

Next, description is given of the configuration of a sheet transportation mechanism of the print apparatus. FIG. 3 shows the sheet transportation mechanism of the print apparatus that includes rear sheet-detection sensor 12, front sheet-detection sensor 13, platen 14, pull-up-roller assembly 15, leaf spring 16, rear push-tractor 17, and front push-tractor 18. The sheet transportation mechanism transports sheets and thus enables print head 8 to execute printing.

Print head 8, which serves as a print unit, transfers ink onto the sheet by pressing print-head pins (not illustrated) onto the ink ribbon while moving by being driven by space motor 9 shown in FIG. 2. The ink is transferred in accordance with the dot-matrix data obtained by developing the received data on the basis of the layout of the print-head pins. Print head 8 is provided between rear push-tractor 17 or front push-tractor 18, and pull-up roller pair 151 of pull-up-roller assembly 15. Print head 8 executes printing while moving in a direction perpendicular to the sheet transportation direction.

Platen 14 is a rotatable member that faces the print dot pins of print head 8. Platen 14 is made of rubber and has a cylindrical or columnar shape. Platen 14 is driven by feed motor 10 shown in FIG. 2 and thereby rotates in directions indicated by arrows A in FIG. 2. The rotating motion of platen 14 sends the sheet upwards or downwards in FIG. 2 (i.e., in vertical directions). The sending of the sheet by platen 14 is referred to as the "feed action." In addition, platen 14 serves as a base to receive the print dot pins that are pressed against the sheet over the ink ribbon by print head 8 when the ink is transferred onto the sheet. Note that while executing printing actions, print head 8 moves back and forth in the horizontal directions that are perpendicular to the directions in which the rotary motion of platen 14 sends the sheet. To put it differently, in the reciprocating motion of platen 14, which is also known as the spacing action, platen 14 moves in the lengthwise directions of platen 14, that is, in the directions in which the rotational axis of platen 14 extends.

Pull-up roller pair 151 is provided in pull-up-roller assembly 15, and serves as a print-medium transportation unit driven to rotate by feed motor 10 shown in FIG. 2. Pull-up-roller assembly 15 is a mechanism to pull up the fed sheet by holding the sheet between pull-up roller pair 151, and is provided downstream of rear push-tractor 17 and front push-tractor 18 in the sheet transportation direction. As pull-up-roller assembly 15 pulls up and transports the sheet, the sheet is made to cling to platen 14 while the printing is being executed. To make the sheet cling to platen 14, pull-up roller pair 151 draws in the sheet by an amount larger than the amount by which the sheet is transported by platen 14.

Leaf spring 16 is a device lightly in contact with the external circumferential surface of platen 14. With leaf spring 16, the sheet sent out by the tractors, which are to be described later, is made to cling to platen 14, and thus the sheet is prevented from floating over platen 14.

Rear push-tractor 17, which serves as a print-medium sender, is driven to rotate by feed motor 10 shown in FIG. 2, and thus transport a continuous sheet set in rear sheet-feed route 171. Rear push-tractor 17 sends the continuous sheet into the interstice between print head 8 and platen 14. Rear sheet-detection sensor 12 is provided between rear push-tractor 17 and both of print head 8 and platen 14. Rear sheet-detection sensor 12 serves as a sheet-end detector to detect the top end and the bottom end of the sheet fed from rear sheet-feed route 171.

Front push-tractor 18, which serves as a print-medium sender, is driven to rotate by feed motor 10 shown in FIG. 2, and thus transport a continuous sheet set in front sheet-feed route 181. Front push-tractor 18 sends the continuous sheet into the interstice between print head 8 and platen 14. Front sheet-detection sensor 13 is provided between front push-tractor 18 and both of print head 8 and platen 14. Front sheet-detection sensor 13 serves as a sheet-end detector to detect the top end and the bottom end of the sheet fed from front sheet-feed route 181.

Next, description is given of the configuration of the control system for the print apparatus. Printer 100 shown in FIG. 1 includes power-on controller 30, data receiver 35, receiver buffer 36, received-data analyzer 37, mechanical controller 40, space controller 50, print-position calculator 51, carriage-movement controller 52, print controller 60, print-speed determiner 61, feed controller 70, and feed-amount-correction controller 71.

Power-on controller 30 performs control when printer 100 is powered on, and thereby initializes the various control circuits and mechanisms of printer 100. Data receiver 35 receives data, sent byte-by-byte, from an unillustrated higher-level device (e.g., a personal computer and a host computer connected to a client terminal used in a service window). Data receiver 35 stores the received data in receiver buffer 36 including RAM 3 shown in FIG. 2. The received data thus stored are read out and processed, piece-by-piece, by received-data analyzer 37.

Received-data analyzer 37 reads out, byte-by-byte, the data received by data receiver 35 and then stored in receiver buffer 36. Received-data analyzer 37 then analyzes the data thus read out from receiver buffer 36. Specifically, received-data analyzer 37 judges whether the readout data are print data that require an instruction to perform printing or a printer-control command that instructs a particular way of controlling printer 100. After the judgment, received-data analyzer 37 processes the data appropriately, and then passes the processed data on to mechanical controller 40.

On the basis of the data processed by received-data analyzer 37, mechanical controller 40 determines the print speed, the print density, and the like. Then, mechanical controller 40 sends instructions to control various components included in the print mechanism—e.g., print head 8, space motor 9, and feed motor 10—to space controller 50, and print controller 60, and feed controller 70.

Space controller 50, which serves as a print-unit movement controller, includes print-position calculator 51 and carriage-movement controller 52. Print-position calculator 51 acquires the print position and the print width from the data received from an unillustrated higher-level device, and thereby determines the way of executing the print action that needs to move print head 8 by the minimum distance. Upon receiving the instruction sent from the print-position calculator 51, carriage-movement controller 52 moves print head 8 to a position indicated by the instruction and then stops print head 8 at that position.

Print controller 60 generates various kinds of information needed for the execution of the printing operation. Some examples of the information thus generated include the resolution of the print, various attributes of the print, and the impact data obtained by developing the print data so that the print-head pins can be arranged as instructed by the print data. Print-speed determiner 61 determines the print speed on the basis of the print density and the like included in the generated impact data. The above-mentioned print density refers to the density of the dots that actually contribute to the printing (or the dots that need the impact) among all the dots included in the generated impact data.

Feed controller 70 controls the feed action executed by feed motor 10 shown in FIG. 2 to transport the sheet. Specifically, for example, feed controller 70 manages the current print position in the vertical direction, generates the amount of feeding to be actually executed (hereinafter, simply referred to as the "actual feed amount," and determines the feed speed. In addition, feed controller performs control on the feed action to be executed when the top end and the bottom end of the sheet are detected by rear sheet-detection sensor 12 or front sheet-detection sensor 13 shown in FIG. 3. Feed controller 70 controls the actual feed amount and the feed speed by controlling the amount and speed of the revolution of feed motor 10 shown in FIG. 2.

Feed-amount correction controller 71, which serves as a transport-amount correction controller, corrects the amount of sheet transportation executed by rear push-tractor 17, front push-tractor 18, and pull-up roller pair 151 shown in FIG. 3. The correction is performed in accordance with the positions of the sheet ends. To this end, rear sheet-detection sensor 12 or front sheet-detection sensor 13 shown in FIG. 3 is used to detect the positions of the top end and the bottom end of the sheet. Then, feed-amount correction controller 71 calculates the amount of feed action suitable for the state of each sheet.

When the feed action is executed, the control performed by feed-amount correction controller 71 corrects the amount of feeding the top end or the bottom end of the sheet in the feed action on the basis of the detected position of the top end or the bottom end of the sheet. The control is described below by referring to FIG. 3.

Before the top end of the sheet reaches the position of pull-up roller pair 151 in pull-up-roller assembly 15, the feed amount is corrected so that the optimal feeding of the sheet is executed on the basis of: the amount of feeding achieved by the pushing-out of the sheet by rear push-tractor 17 or front push-tractor 18; the position of the top end of the sheet; and the head-gap position.

With this correction of the feed amount, the amount of feeding the sheet by the pushing-out performed by rear push-tractor 17 or front push-tractor 18 is increased from the corresponding amount of the cases where the top end of the sheet reaches the position of pull-up roller pair 151 in pull-up-roller assembly 15.

If rear sheet-detection sensor 12 or front sheet-detection sensor 13 detects the bottom end of the sheet and finds that the bottom end is off rear push-tractor 17 or front push-tractor 18, the feed amount is corrected so that the optimal feeding of the sheet is executed on the basis of: the amount of feeding achieved by the pulling-up by pull-up roller pair 151 in pull-up-roller assembly 15; the position of the bottom end of the sheet; and the head-gap position.

With this correction of the feed amount, the amount of feeding the sheet by the pulling-up performed by pull-up roller pair 151 in pull-up-roller assembly 15 is reduced from the corresponding amount of the cases where the bottom end of the sheet is not off rear push-tractor 17 or front push-tractor 18.

The control system of printer 100 with the above-described configuration controls the overall operations of printer 100 by using CPU 1, ROM 2, RAM 3, LSI 4, print-head drive circuit 5, space-motor drive circuit 6, feed-motor drive circuit 7, print head 8, space motor 9, feed motor 10, head-gap detection sensor 11, rear sheet-detection sensor 12, and front sheet-detection sensor 13 shown in FIG. 2.

Next, description is given of the advantageous effect obtained by the above-described configuration. Firstly, description is given of various conditions of the sheet by referring FIGS. 3 and 4. Note that different conditions of the sheet result from different positions of the top end of the sheet. Note also that the following description assumes that the sheet is fed from rear sheet-feed route 171.

Now suppose a case where the top end of the sheet is positioned within zone L1 in FIG. 3. Zone L1 is the zone extending from the most downstream position, in the sheet transportation direction (i.e., the direction toward print head 8), of the portion where leaf spring 16 and platen 14 are in contact with each other to the portion where pull-up roller pair 151 in pull-up-roller assembly 15 are in contact with each other. In this case, the sheet is transported by the feeding only in the direction in which rear push-tractor 17 pushes out the sheet. The top end of the sheet has not reached the contact portion of pull-up roller pair 151, so that no feeding is achieved by the pulling-up of the sheet by pull-up roller pair 151.

Figure 4:
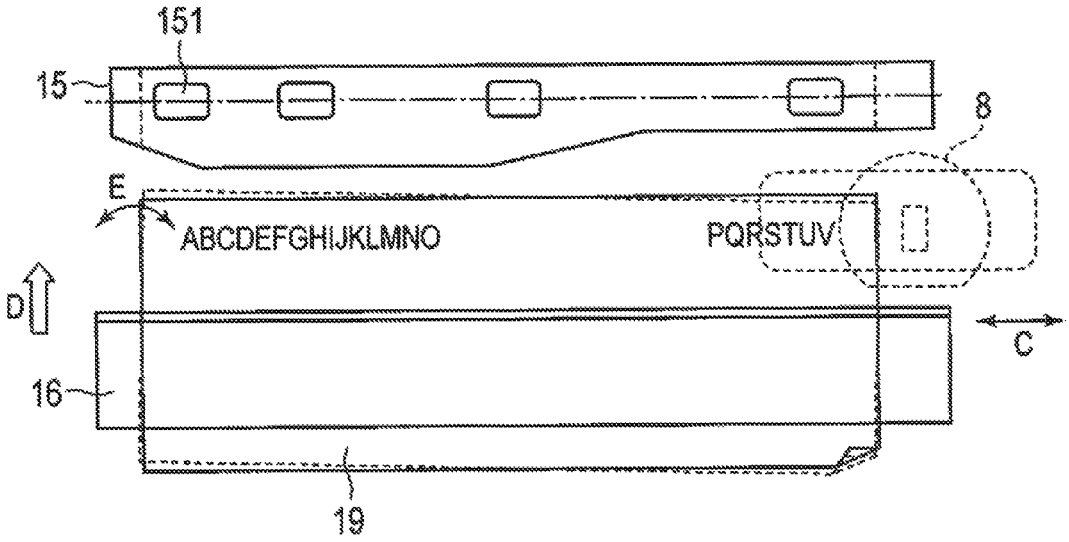
FIG. 4 is a view illustrating the way of transporting a sheet in the print apparatus according to the first embodiment.

FIG. 4 is a diagram to describe the sheet transportation performed in the print apparatus according to the first embodiment, and illustrates a state where the top end of the sheet has not reached the contact portion of pull-up roller pair. Note that FIG. 4 is a view showing leaf spring 16, print head 8 and pull-up-roller assembly 15 in FIG. 3 as viewed in the direction indicated by arrow B in FIG. 3.

FIG. 4 shows a state where the top end of sheet 19 has not reached the contact portion of pull-up roller pair 151 and the bottom end of sheet 19 is off rear push-tractor 17. In this state, sheet 19 is fixed only by being held by and between leaf spring 16 and platen 14 (not illustrated in FIG. 4). If printing actions are executed in this state, leaf spring 16 and platen 14 can hold sheet 19 with a force of only a limited magnitude, so that sheet 19 is easily moved by the movement of print head 8 in the horizontal directions as indicated by arrows C in FIG. 4 during the printing actions. The directions in which sheet 19 is moved are indicated by arrows E in FIG. 4, and are substantially perpendicular to the direction in which sheet 19 is fed (i.e., the direction indicated by arrow D in FIG. 4).

Now suppose another state where the top end of sheet 19 has not reached the contact portion of pull-up roller pair 151 but the bottom end of sheet 19 is held by rear push-tractor 17. In this state, sheet 19 is held at two positions: by rear push-tractor 17 at one position; and by leaf spring 16 and platen 14 (not illustrated in FIG. 4) at the other position. So sheet 19 is held with larger force in this state than in the state where the bottom end of sheet 19 is off rear push-tractor 17. Accordingly, if printing actions are executed in this state, the movement of print head 8 during the print actions causes smaller wobbles of sheet 19 in directions indicated by arrows E in FIG. 4.

Figure 5:
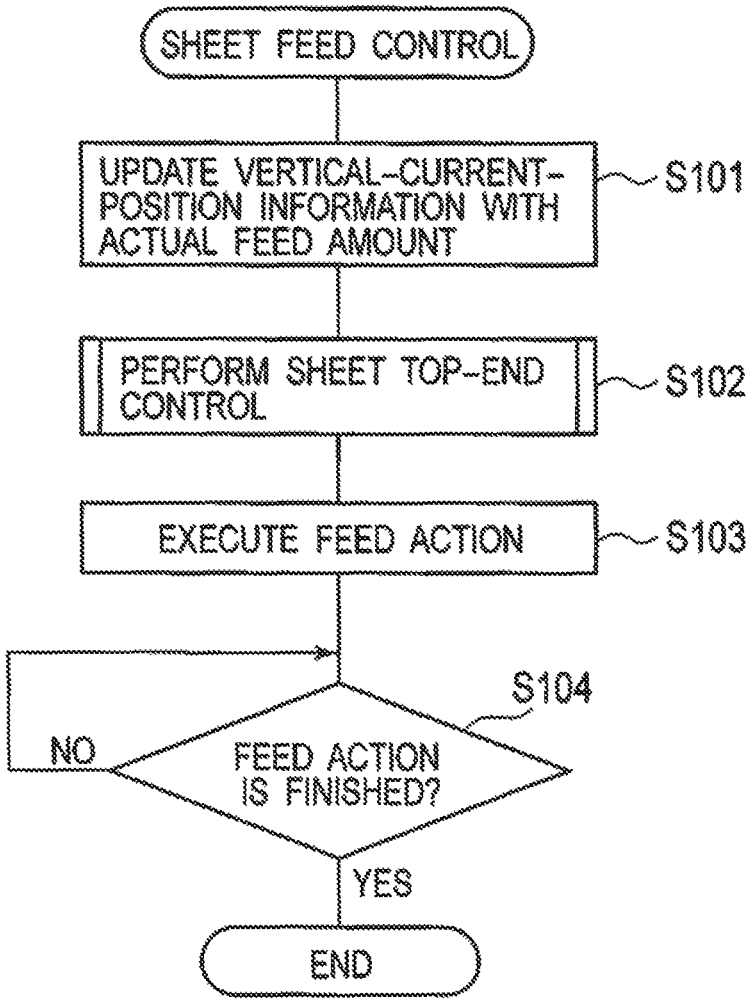
FIG. 5 is a flowchart illustrating sheet feed control processing according to the first embodiment.

Next, sheet feed control processing performed by feed controller 70 and feed-amount correction controller 71 shown in FIG. 1 is described by referring to FIG. 1 and by following steps represented by S in FIG. 5, which is a flowchart illustrating the sheet feed control processing according to the first embodiment.

S101: When printer 100 executes the feed action to transport a sheet, feed controller 70 calculates the actual feed amount for the sheet. Then, the vertical current position, in the sheet transportation direction, of the top end of the sheet is calculated from the actual feed amount by feed controller 70. The vertical-current-position information stored in RAM 3 is updated with the newly-calculated vertical current position. The vertical current position is managed by summing up the amounts by which the top end of the sheet moves (i.e., the feed amounts) since the top end of the sheet is detected by rear sheet-detection sensor 12.

S102: After the updating of the vertical-current-position information, feed controller 70 executes the sheet top-end control processing. The details of the sheet top-end control processing are to be described later. S103: After the execution of the sheet top-end control processing, feed controller 70 executes the feed action. S104: Feed controller 70 monitors the feed action until the feed action is finished. Once the feed action is finished, feed controller 70 finishes the sheet feed control processing.

Figure 6:
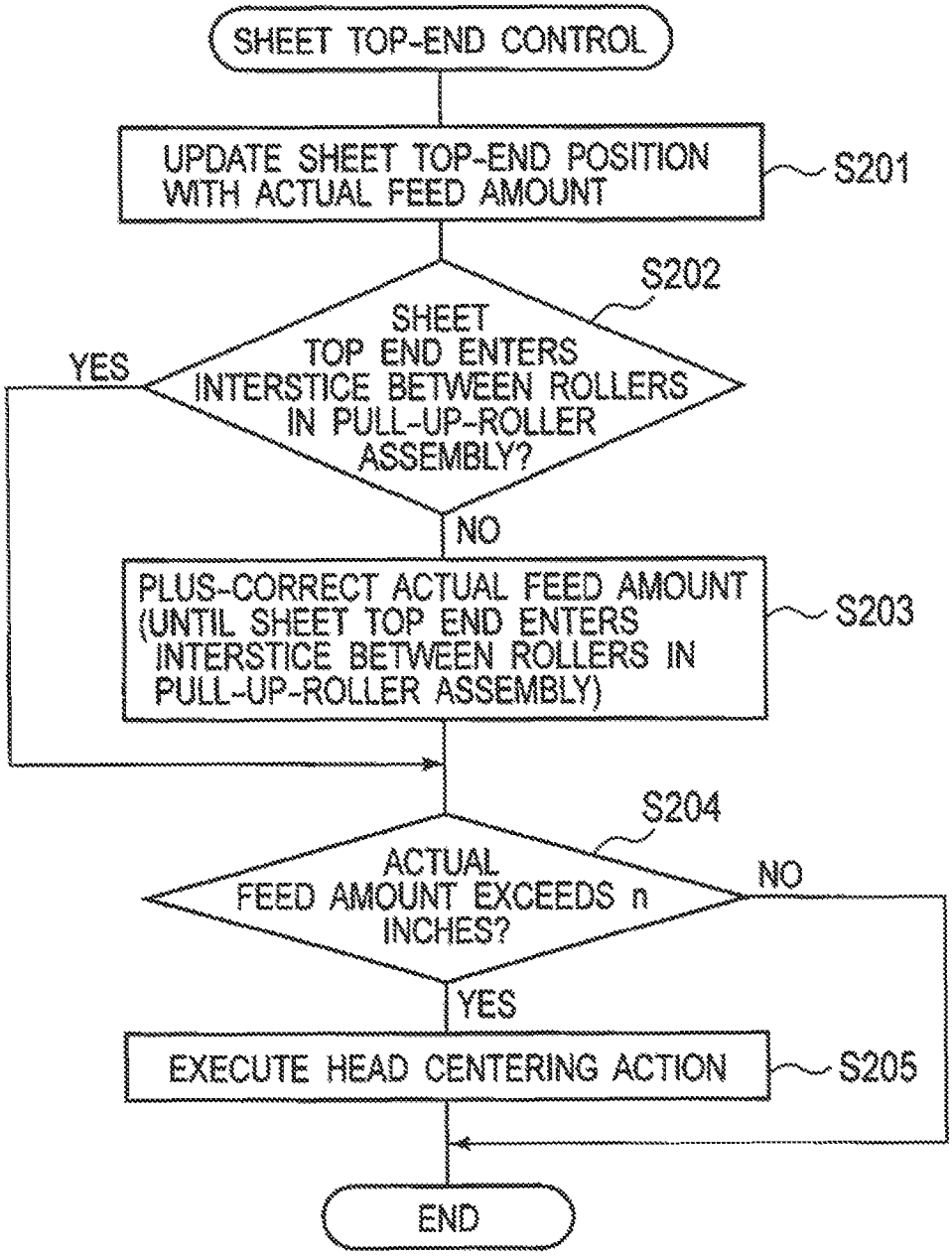
FIG. 6 is a flowchart illustrating sheet top-end control processing according to the first embodiment.

Next, sheet top-end control processing performed by feed controller 70 and feed-amount correction controller 71 shown in FIG. 1 are described with reference to FIGS. 1 and 3 by following steps represented by S in FIG. 6, which shows a flowchart illustrating the sheet top-end control processing according to the first embodiment.

S201: Feed controller 70 calculates the amount of sheet feeding to be actually executed, that is, the actual feed amount for the case where the sheet is sent out by rear push-tractor 17 after the top end of the sheet enters the contact portion of pull-up roller pair 151 in pull-up-roller assembly 15. Then, on the basis of the calculated actual feed amount and the vertical-current-position information, feed controller 70 calculates the position, in the sheet transportation direction, of the top end of the sheet after the execution of the feed action. Then, feed controller 70 uses the calculated position of the top end of the sheet to update the information of the sheet top-end position stored in RAM 3.

S202: On the basis of the updated information of the sheet top-end position, feed controller 70 judges whether or not the top end of the sheet is to enter the contact portion of, and be held by, pull-up roller pair 151 in pull-up-roller assembly 15. If feed controller 70 judges that the top end of the sheet is to enter the contact portion of pull-up roller pair 151, the processing moves to S204. If, in contrast, feed controller 70 judges that the top end of the sheet is not to enter the contact portion of pull-up roller pair 151, the processing moves to S203.

S203: if the top end of the sheet is not to enter the contact portion of pull-up roller pair 151, feed-amount correction controller 71 uses the feed-amount correction table shown in FIG. 7 and thereby corrects the actual feed amount calculated at S201. Thus calculated is an optimal amount of feeding to be actually executed by rear push-tractor 17. Then, feed controller 70 executes the feed action to be performed by rear push-tractor 17 with the corrected actual feed amount.

Now suppose a case where no feed action is caused by the pulling-up of the top end of the sheet by pull-up roller pair 151 in pull-up-roller assembly 15. In this case, the feed amount by which the sheet actually moves during the feed action performed by the pushing-out by the rear push-tractor or the front push-tractor is smaller than the feed amount of the case where some feed action is caused by the pulling-up of the top end of the sheet performed by pull-up roller pair 151 in pull-up-roller assembly 15.

Accordingly, the actual feed amount is corrected by extracting the feed amount corresponding to the shortfall as a feed-correction amount from the feed-amount correction table shown in FIG. 7, and then adding the extracted feed-correction amount to the actual feed amount calculated at S201.

In practice, sheets of different thicknesses (e.g. copying paper, postcards, etc.) used in the printing move by different feed amounts. So, when the correction of the actual feed amount is performed, the thickness of the currently-used sheet is judged on the basis of a head-gap setup information readout by head-gap detection sensor 11. In this way, the correction of the actual feed amount is made most suitable for the thickness of the sheet.

FIG. 7 shows a feed-amount correction table. For example, the head-gap setup information of "1" corresponds to the feed-correction amount of "1/360 inches for every 0.3-inch feed." The head-gap setup information of "2" corresponds to the feed-correction amount of "1/360 inches for every 0.275-inch feed." The head-gap setup information of "3 and 4" corresponds to the feed-correction amount of "1/360 inches for every 0.25-inch feed." The head-gap setup information of "5 to 8" corresponds to the feed-correction amount of "1/360 inches for every 0.225-inch feed." Each feed-correction amount is added to the corresponding actual feed amount. The feed-correction amount is added after the start of the sheet feeding until the top end of the sheet reaches the contact portion of pull-up roller pair 151 in pull-up-roller assembly 15.

If the head-gap setup information is "1" and if the actual feed amount before the correction is 1 inch, for example, the actual feed amount after the correction is (1+1/120) inches. For example, the head-gap setup information is settable to any of eight levels of "1" to "8." The value "1 represents the thinnest sheet" (e.g. plain paper), and the value "8" represents the thickest sheet (the same applies in the following description).

S204: Feed controller 70 judges whether or not the actual feed amount after the correction exceeds n inches (e.g., 1 inch). If feed controller judges that the actual feed amount after the correction exceeds n inches, the processing moves to S205. If feed controller judges that the actual feed amount after the correction does not exceed n inches, the processing is finished. S205: Feed controller 70 notifies, via mechanical controller 40, space controller 50 of the fact that actual feed amount after the correction exceeds n inches. Then, space controller 50 executes a centering action to move print head 8 to the most suitable position for the feed action (e.g., to the center, in the horizontal direction) that print head 8 can be moved to. Then, the sheet top-end control processing is finished.

Figure 8:
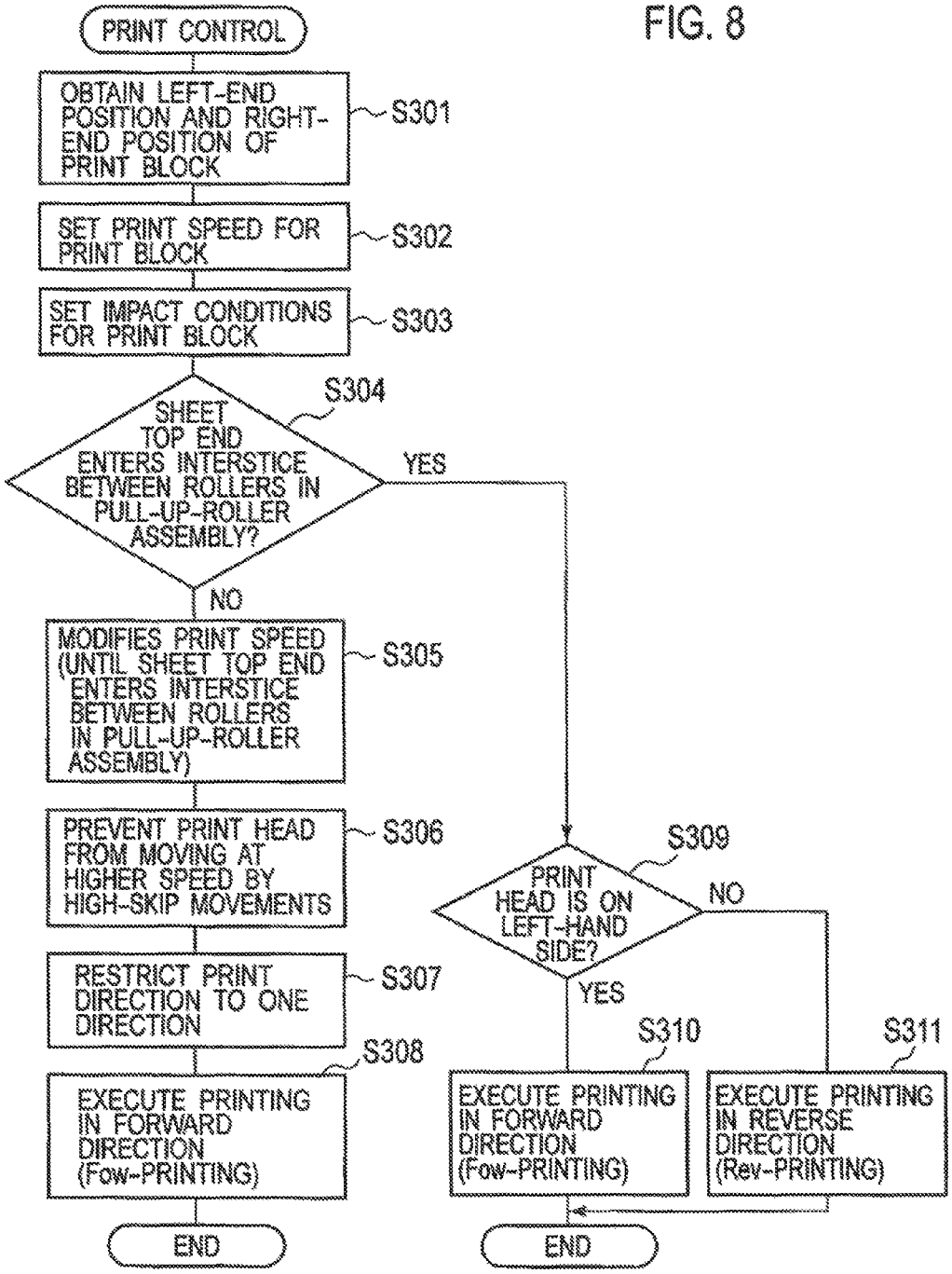
FIG. 8 is a flowchart illustrating print control processing according to the first embodiment.

Next, print control processing performed by space controller 50 and print controller 60 shown in FIG. 1 are described by referring to FIGS. 1 and 3 as well as by following 300-series steps in FIG. 8, which shows a flowchart illustrating the print control processing according to the first embodiment.

The print control processing of the first embodiment aims to prevent the degradation of the print quality, such as printing at incorrect positions in the top-end area of the sheet. Before the top end of the sheet reaches the contact portion of pull-up roller pair 151 in pull-up-roller assembly 15, the sheet is fed only by the pushing-out by rear push-tractor 17 or front push-tractor 18 because the pull-up roller pair 151 cannot perform any feed action by pulling-up. Hence, the unfixed top end of the sheet is moved by the movement of print head 8 during the print action, resulting in the degradation of the print quality such as printing at incorrect positions in the top-end area of the sheet.

The print control processing of the first embodiment reduces the degradation of the print quality in the following way. Before the top end of the sheet reaches the contact portion of pull-up roller pair 151 in pull-up-roller assembly 15, control is executed to reduce the print speed (the moving speed of print head 8) and/or to restrict a print direction (a moving direction of print head 8 in performing the printing action) to a single direction. Note that the print control processing described in the following paragraphs is the print control processing for only one line.

S301: With the instruction from space controller 50, print-position calculator 51 obtains, from the received data, the left-end position and the right-end position, in the horizontal direction, of the print area to be printed next (hereinafter, that print area is referred to as the "print block"). On the basis of the left-end position and the right-end position of the print block that are calculated as above, and on the basis of the current waiting position of print head 8, a judgment of print direction, which is to be described in detail later, is executed.

S302: With the instruction from print controller 60, print-speed determiner 61 determines the print speed for the printing in the next print block, the print speed thus determined is stored in RAM 3, and then the print speed is set. The print speed is determined on the basis of the print density for the printing of the next print block. If, for example, the print density is 45%, the print speed is slowed down to the 83% speed of the standard print speed. If the print density is 50%, the print speed is slowed down to the 75% speed of the standard print speed.

S303: Print controller 60 sets the impact conditions of print head 8 for the printing of the next print block. The above-mentioned impact conditions refer to the timings at which the head pins of print head 8 are driven. The timings are determined on the basis of the print density and the print speed. Specifically, for example, the impact conditions include the timing at which the head pins are pushed out, the duration for which the head pins are kept at pushed-out positions, and the timing at which the head pins are retracted.

S304: On the basis of the current position of the top end of the sheet, print controller 60 judges whether or not the top end of the sheet is in the contact portion of, and is thus held by and between, pull-up roller pair 151 in pull-up-roller assembly 15. If print controller 60 judges that the top end of the sheet is in the contact portion of pull-up roller pair 151, the processing moves to S309. If, in contrast, the top end of the sheet is not in the contact portion of pull-up roller pair 151, the processing moves to S305.

S305: If print controller 60 judges that the top end of the sheet is not in the contact portion of pull-up roller pair 151, print controller 60 modifies (corrects) the print speed determined at S302 because the top end of the sheet is not fixed at the contact portion of pull-up roller pair 151. To perform the correction, print controller 60 extracts a print-speed reduction ratio from the print-speed reduction table stored in ROM 2. This print-speed reduction table is used to correct the print speed optimally for the sheets with various thicknesses. To this end, a judgment is performed to identify the currently-used sheet on the basis of the head-gap setup information read out by head-gap detection sensor 11. Print controller 60 slows down and corrects the print speed determined at S302 on the basis of the print-speed reduction ratio. As FIG. 9 shows for example, if the head-gap setup information is "1," the print-speed reduction ratio of 95% is used. If the head-gap setup information is "2," the print-speed reduction ratio of 90% is used. If the head-gap setup information is "3 and 4," the print-speed reduction ratio of 80% is used. If the head-gap setup information is "5 to 8," the print-speed reduction ratio of 70% is used.

Different sheets (e.g. copying paper, postcards, etc.) used in the printing have different frictions and loads in the print direction. For this reason, in this print control processing, as in the correction of the actual feed amount by the sheet top-end control processing described earlier, the print speed is determined by identifying a print sheet for printing by using the head-gap setup information, by calculating the optimal print speed according to the thickness of the sheet, and by correcting (decreasing) the print speed appropriately. Accordingly, the movement of print head 8 during the printing causes smaller wobbles of the top end of the sheet in horizontal directions.

S306: As the top end of the sheet is not in the contact portion of pull-up roller pair 151, space controller 50 performs control to prevent print head 8 from moving at a higher speed by high-skip movements at the time when no printing is actually made. The faster movements of print head 8 in the horizontal direction over the sheet is prevented to reduce as much as possible the wobbles of the top end of the sheet in the horizontal direction by the faster movements of print head 8.

S307: Space controller 50 restricts the allowable print direction to only one direction, that is, prevents the bi-directional print action, and thereby reduces the misplacement of the sheet by the printing performed by the reciprocal movement of print head 8 in the horizontal directions. S308: Space controller 50 restricts the print direction to the forward direction only, and executes the printing (Fow-printing) while print head 8 is moving in this direction. Then, space controller 50 finishes the print control processing.

S309: If, in contrast, print controller 60 judges at S304 that the top end of the sheet is in the contact portion of pull-up roller pair 151, print controller 60 determines which print direction is to be allowed for minimize the time needed for the printing. To determine the print direction, print controller 60 relies on the current position of print head 8 and on the left-end position and the right-end position of the print block obtained at S301. If print controller 60 judges that print head 8 is currently on the left-hand side or at the center of the print block to be printed next, the processing moves to S310. If, in contrast, print controller 60 judges that print head 8 is currently on the right-hand side of the print block, the processing moves to S311.

S310: If print controller 60 judges that print head 8 is currently at the left-hand side of the central position of the print block to be printed next or at the center of the print block, space controller 50 restricts the print direction to the forward direction only, and executes the printing (Fow-printing) from the left-hand end while print head 8 is moving in this direction. Then, space controller 50 finishes the print control processing.

S311: If print controller 60 judges that print head 8 is currently at the right-hand side of the central position in the print block to be printed next, space controller 50 restricts the print direction to the reverse direction only, and executes the printing (Rev-printing) from the right-hand end while print head 8 is moving in this direction. Then, space controller 50 finishes the print control processing.

As has been described, if the top end of the sheet is not in the contact portion of pull-up roller pair 151, feed-amount correction controller 71 adds a correction value to the actual feed amount calculated on the basis of the received data to obtain an optimally-corrected actual feed amount. Accordingly, misplacement by too short a feed amount can be avoided. Consequently, the sheet can be transported with higher precision, and the print quality can also be improved.

In addition, if the top end of the sheet is not in the contact portion of pull-up roller pair 151, print controller 60 corrects, by slowing down, the print speed determined on the basis of the received data. Accordingly, the wobbling of the sheet in the horizontal direction by the movements of print head 8 during the print action can be reduced. Consequently, the sheet can be transported with higher precision, and the print quality can also be improved.

Furthermore, if the top end of the sheet is not in the contact portion of pull-up roller pair 151, space controller 50 prevents print head 8 from moving at a higher speed by high-skip movements. Accordingly, space controller 50 can prevent the faster movements of print head 8 from wobbling the sheet in the horizontal direction. Consequently, the sheet can be transported with higher precision, and the print quality can also be improved.

As has been described, the first embodiment can obtain the following advantageous effects. If the top end of the sheet is not in the contact portion of the pull-up roller pair, a correction value is added to the actual feed amount calculated on the basis of the received data to obtain an optimally-corrected actual feed amount. Accordingly, misplacement by too short a feed amount can be avoided. Consequently, the sheet can be transported with higher precision, and the print quality can also be improved.

In addition, the first embodiment can obtain the following advantageous effects. The print speed determined on the basis of the received data is corrected by slowing down the print speed. Accordingly, the wobbling of the sheet in the horizontal direction by the movements of the print head during the print action can be reduced. Consequently, the sheet can be transported with higher precision, and the print quality can also be improved. Furthermore, the following advantageous effects can be obtained as well. The print head is prevented from moving at a higher speed. Accordingly, the sheet can be prevented from wobbling in the horizontal direction. Consequently, the sheet can be transported with higher precision, and the print quality can also be improved.

Comparative Example

Figure 18:
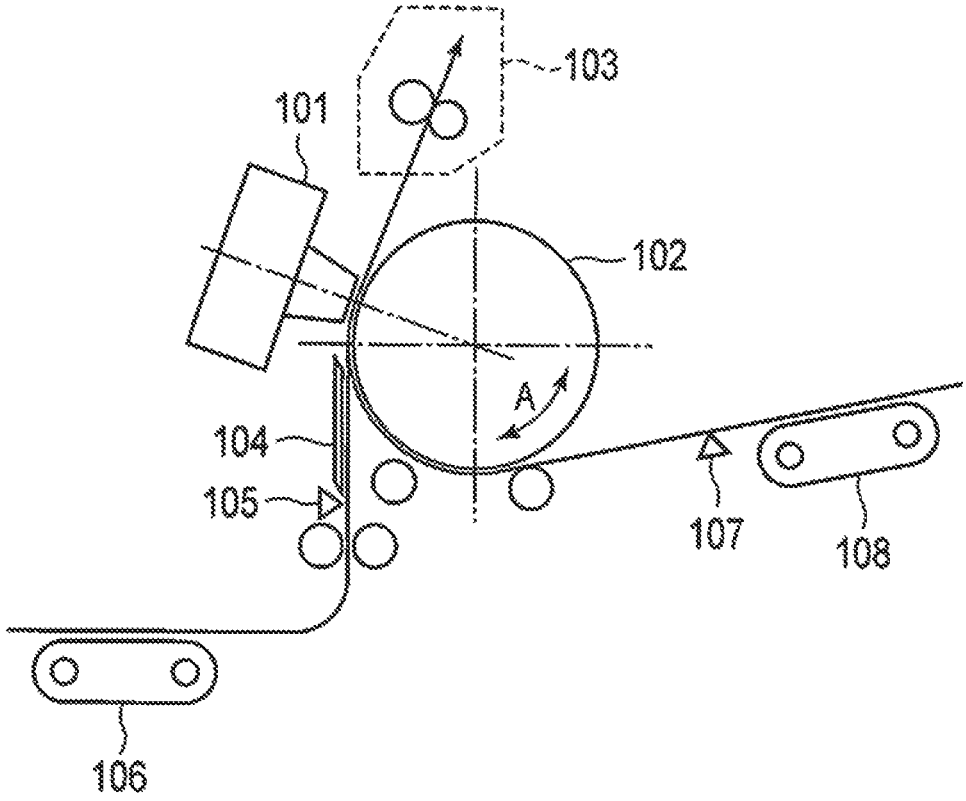
FIG. 18 is a schematic side view showing a structure of a sheet transportation mechanism of the print apparatus according to the related art.
Figure 19:
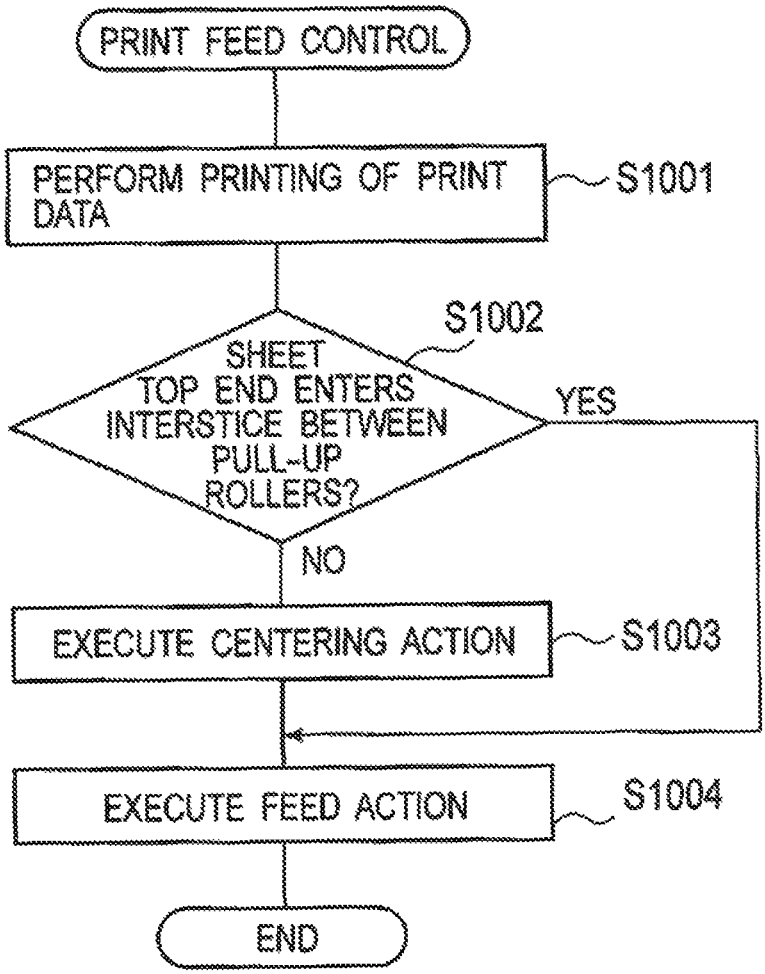
FIG. 19 is a flowchart illustrating sheet feed control processing according to the related art.

A print apparatus of a comparative example equipped with a sheet transportation mechanism including a tractor, a pull-up roller and the like is described by referring to FIGS. 18 and 19.

Print head 101 shown in FIG. 18 transfers ink onto the sheet by making the print-head pins press the ink ribbon against the sheet in accordance with the dot-matrix data obtained by developing the received data on the basis of the layout of the print-head pins. Platen 102 is a rubber-made member, and rotates to perform a feed action that sends the sheet upwards or downwards in FIG. 18. In addition, platen 102 serves as a base to receive the print dot pins that are pressed against the sheet over the ink ribbon by print head 101 when the ink is transferred onto the sheet.

A pull-up roller pair is provided in pull-up-roller assembly 103. Pull-up-roller assembly 103 is a mechanism to make the pull-up roller pair pull up the sheet fed to the position of the pull-up roller pair. As pull-up-roller assembly 103 pulls up the sheet, the sheet is made to cling to platen 102 while the printing is being executed. To make the sheet cling to platen 102, the pull-up roller pair draws in the sheet by an amount larger than the amount by which platen 102 transports the sheet.

Leaf spring 104 is a device with which the sheet sent out by the tractors is made to cling to platen 102, and which prevents the sheet from floating over platen 102. More details of the tractors are to be described later. Front sheet-detection sensor 105 is a sensor to detect the top end and the bottom end of the sheet fed from a front sheet-feed route. Front push-tractor 106 is a mechanism to transport a continuous sheet fed from the front sheet-feed route. Rear sheet-detection sensor 107 is a sensor to detect the top end and the bottom end of the sheet fed from a rear sheet-feed route. Rear push-tractor 108 is a mechanism to transport a continuous sheet set in the rear sheet-feed route.

The operations of the print apparatus of the comparative example are described on the basis of FIG. 19 and by referring to FIG. 18. Note that, at a point immediately after the sheet-feed action by which the front push-tractor or the rear push-tractor sends out the sheet, the top end of the sheet is stopped at a position where the top end has not reached the pull-up rollers in pull-up-roller assembly 103 shown in FIG. 18.

S1001: Wherever the top end of the fed sheet is located, the front push-tractor or the rear push-tractor is used to send out the sheet, and a print action is performed by print head 101.

S1002: Using an unillustrated sensor or the like, a judgment is executed to judge whether or not the top end of the sheet has entered the interstice between the pull-up rollers in pull-up-roller assembly 103. If it is judged that the top end of the sheet has entered the interstice between the pull-up rollers in pull-up-roller assembly 103, the processing moves to S1004. If, in contrast, it is judged that the top end of the sheet has not entered the interstice between the pull-up rollers in pull-up-roller assembly 103, the processing moves to S1003.

S1003: If print data and feed-execution command (linefeed command) are received after the judgment at S1002 that the top end of the sheet has not entered the interstice between the pull-up rollers in pull-up-roller assembly 103, a centering action to move print head 101 to a predetermined position is performed after the print action is finished but before the feed action is executed.

The centering action is performed for the following reason. Until the top end of the sheet enters pull-up-roller assembly 103, the top-end portion of the sheet is floating over platen 102. If the feed action is performed in the above-described sheet state, the top end of the fed sheet is stuck in pull-up-roller assembly 103, resulting in the jamming of the sheet. The jamming of the sheet due to the floating of the top end of the sheet is prevented as much as possible by moving print head 101 to a predetermined position (e.g., to the center of the sheet) before the execution of the feed action. With the centering action, the feed action can be performed without causing the top end of the fed sheet to be stuck in pull-up-roller assembly 103, so that the feed action can be performed smoothly.

S1004: If it is judged, at S1002 described above, that the top end of the sheet has not entered the interstice between the pull-up rollers in pull-up-roller assembly 103, the above-described print action and feed action are executed repeatedly until the top end of the sheet enters the interstice between the pull-up rollers in pull-up-roller assembly 103.

If, in contrast, it is judged, at S1002 described above, that the top end of the sheet has entered the interstice between the pull-up rollers in pull-up-roller assembly 103, the feed action is performed without performing the centering action, and then the control on the top end of the sheet is finished. Note that no special control is performed to control the print action or the feed action for the bottom-end area of the sheet.

In the above-described comparative example, however, until the top end of the sheet enters the interstice between the pull-up rollers in pull-up-roller assembly 103, the feed action is executed only by the pushing-out of the sheet performed by front push-tractor 106 or rear push-tractor 108. The top end of the sheet is not pulled up by the pull-up rollers in pull-up-roller assembly 103. Accordingly, looseness of the sheet and shortening of feed amount (insufficient feed amount) occur. Consequently, the sheet may possibly be transported with lower precision, resulting in lower print quality.

In addition, after the bottom end of the sheet comes off front push-tractor 106 or rear push-tractor 108, the feed action is performed only by the pulling-up by the pull-up roller pair in pull-up-roller assembly 103. Accordingly, looseness of the bottom end of the sheet and stretching of the feed amount (excessive feed amount) occur, resulting in an imprecise feed amount. Consequently, the sheet may possibly be transported with lower precision, resulting in lower print quality.

Unlike the comparative example, if, in the first embodiment, the top end of the sheet has not entered the contact portion of pull-up roller pair 151, an optimally-corrected actual feed amount is calculated by adding an appropriate correction value to the actual feed amount calculated on the basis of the received data. Accordingly, the shortening of the feed amount can be prevented from causing the misplacement of the sheet. Consequently, the sheet can be transported with higher precision, and the print quality can be improved.

In addition, in the first embodiment, a correction is performed by slowing down the print speed determined on the basis of the received data. Hence, the movements of print head 8 during the print action can be prevented from causing the wobbling of the sheet in the horizontal direction. Accordingly, the sheet can be transported with higher precision, and the print quality can be improved. Furthermore, in the first embodiment, print head 8 is prevented from moving at a higher speed. Hence, the wobbling of the sheet in the horizontal direction can be reduced. Consequently, the sheet can be transported with higher precision, and the print quality can be improved.

Second Embodiment

The Second embodiment shares, with the first embodiment, the configuration of the print apparatus, the configuration of the sheet transportation mechanism for the print apparatus, and the configuration of the control system for the print apparatus shown in FIGS. 1 to 3. The portions included in these configurations are denoted by the same reference numerals used in the first embodiment. No description of such portions is given below. In the following paragraphs, the different conditions of the sheet caused by different positions of the bottom end of the sheet are described by referring to FIGS. 10 and 11. Note that the following description assumes that the sheet is fed from rear sheet-feed route 171.

Figure 10:
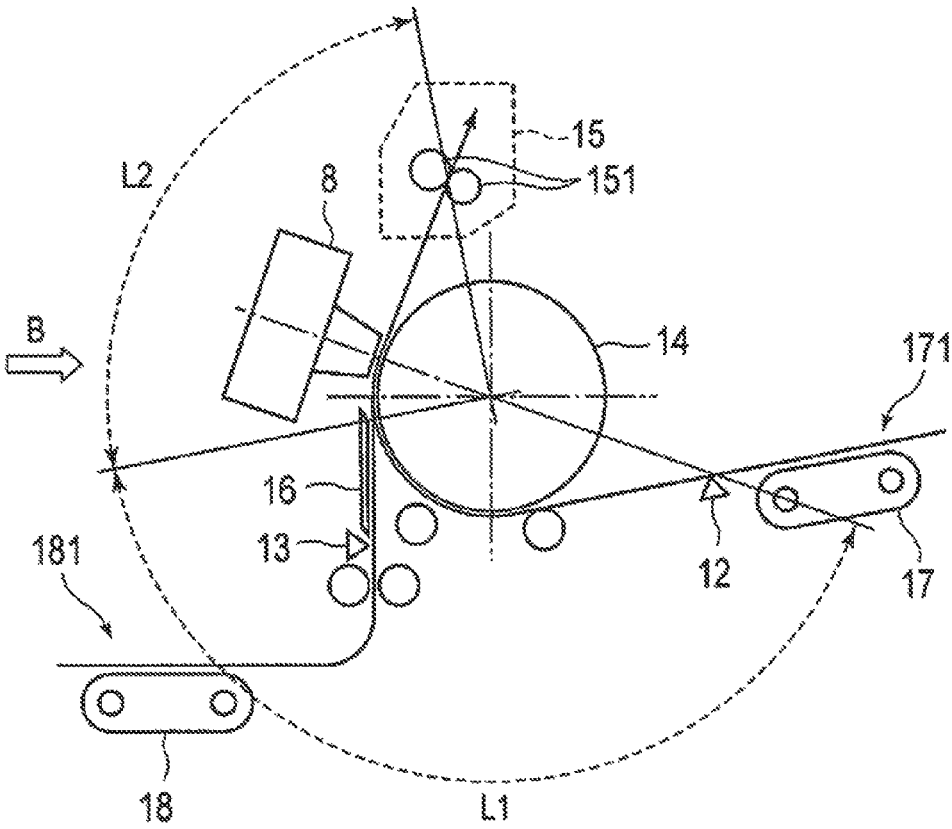
FIG. 10 is a schematic side view showing a structure of a sheet transportation mechanism of the print apparatus according to a second embodiment.

Zone L1 in FIG. 10 refers to a zone staring from rear sheet-detection sensor 12 and ending at the most downstream position, in the sheet transportation direction (i.e., in the direction towards print head 8), of the portion where leaf spring 16 and platen 14 are in contact with each other. Zone L2 refers to a zone starting from the most downstream position, in the sheet transportation direction (i.e., in the direction towards print head 8), of the portion where leaf spring 16 and platen 14 are in contact with each other and ending at the contact portion of pull-up roller pair 151 in pull-up-roller assembly 15.

While the bottom end of the sheet is located within Zone L1, the sheet is transported only by the feeding in the direction in which pull-up roller pair 151 in pull-up-roller assembly 15 pulls up the sheet. As the bottom end of the sheet is not off leaf spring 16 yet, the bottom end of the sheet is held by and between leaf spring 16 and platen 14.

In addition, while the bottom end of the sheet is located within Zone L2, the sheet is transported only by the feeding in the direction in which pull-up roller pair 151 in pull-up-roller assembly 15 pulls up the sheet. However, since the bottom end of the sheet is not off leaf spring 16 yet, the bottom end of the sheet is not held by and between leaf spring 16 and platen 14.

Figure 11:
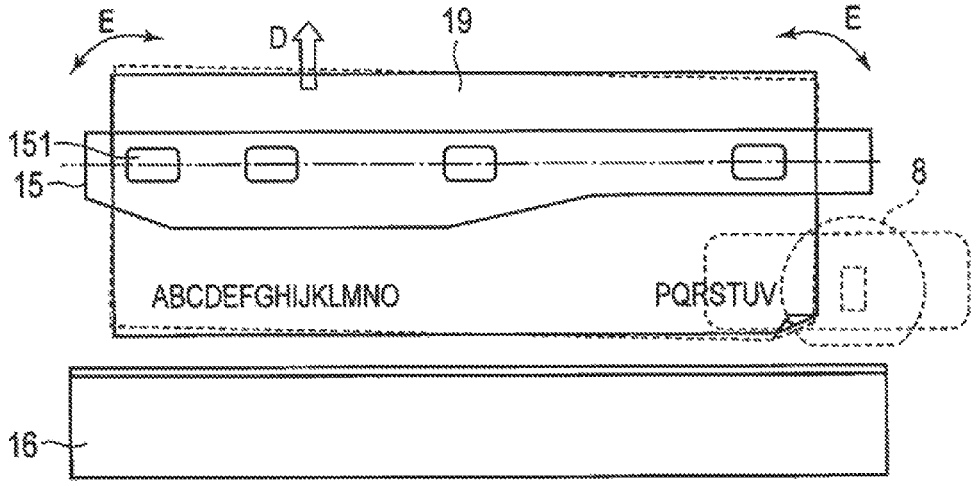
FIG. 11 is a view illustrating the way of transporting a sheet in the print apparatus according to the second embodiment.

FIG. 11 is a diagram to describe the sheet transportation performed in the print apparatus according to the second embodiment, and illustrates a state where the bottom end of the sheet is off leaf spring 16. Note that FIG. 11 is a view showing leaf spring 16, print head 8 and pull-up-roller assembly 15 in FIG. 10 as viewed in the direction indicated by arrow B in FIG. 3.

FIG. 11 shows a state where the bottom end of sheet 19 is already off leaf spring 16. In this state, sheet 19 is fixed only by the contact portion of pull-up roller pair 151 in pull-up-roller assembly 15. If printing actions are executed in this state, the contact portion of pull-up roller pair 151 can hold sheet 19 with a force with only a limited magnitude, so that sheet 19 is easily moved by the movement of print head 8 in the horizontal directions as indicated by arrows C in FIG. 11 during the printing actions. The directions in which sheet 19 is moved are indicated by arrows E in FIG. 11, and are substantially perpendicular to the direction in which sheet 19 is fed (i.e., the direction indicated by arrow D in FIG. 11).

Now suppose another state where the bottom end of sheet 19 is held by and between leaf spring 16 and platen 14. In this state, sheet 19 is held at two positions: by the contact portion of pull-up roller pair 151 in pull-up-roller assembly 15 at one position; and by leaf spring 16 and platen 14 at the other position. So sheet 19 is held with a larger force in this state than in the state where the bottom end of sheet 19 is off leaf spring 16. Accordingly, if printing actions are executed in this state, the movement of print head 8 during the print actions causes smaller wobbles of sheet 19 in directions indicated by arrows E in FIG. 4.

Figure 12:
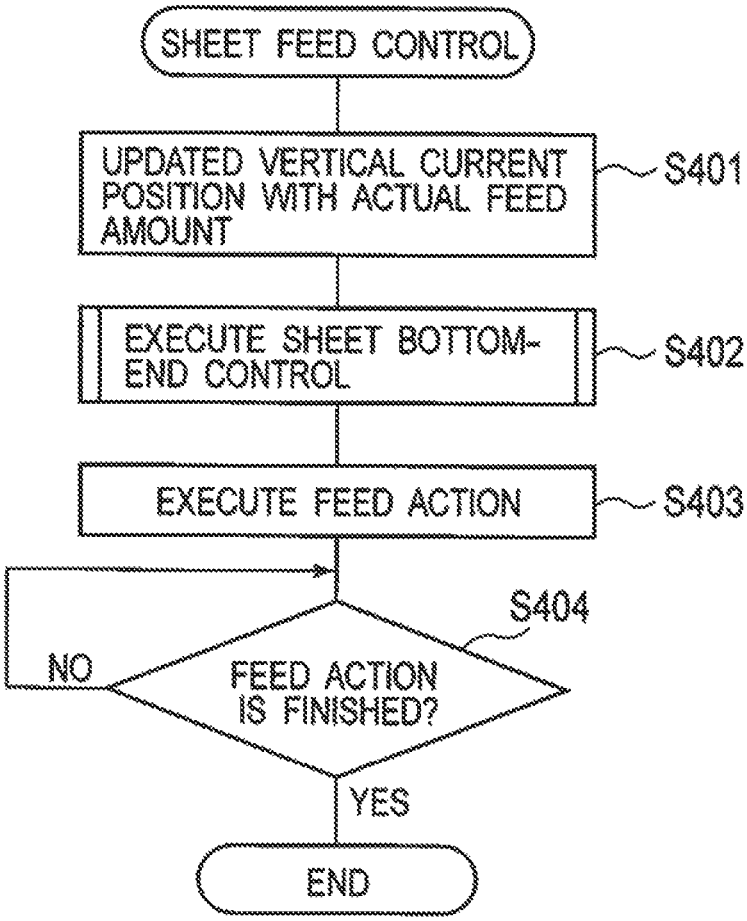
FIG. 12 is a flowchart illustrating sheet feed control processing according to the second embodiment.

Next, sheet feed control processing performed by feed controller 70 and feed-amount correction controller 71 shown in FIG. 1 are described by referring to FIG. 1 and by following steps represented by S in FIG. 12, which is a flowchart illustrating the sheet feed control processing according to the second embodiment.

S401: When printer 100 executes the feed action to transport a sheet, feed controller 70 calculates the actual feed amount for the sheet. Then, the vertical current position, in the sheet transportation direction, of the bottom end of the sheet is calculated from the actual feed amount by feed controller 70. The vertical-current-position information stored in RAM 3 is updated with the newly-calculated vertical current position. The vertical current position is managed by summing up the amounts by which the bottom end of the sheet moves (i.e., the feed amounts) since the top end of the sheet is detected by rear sheet-detection sensor 12.

S402: After the updating of the vertical-current-position information, feed controller 70 executes a sheet bottom-end control processing. The details of the sheet bottom-end control processing are to be described later. S403: After the execution of the sheet bottom-end control processing, feed controller 70 executes the feed action. S404: Feed controller 70 monitors the feed action until the feed action is finished. Once the feed action is finished, feed controller 70 finishes the sheet feed control processing.

Figure 13:
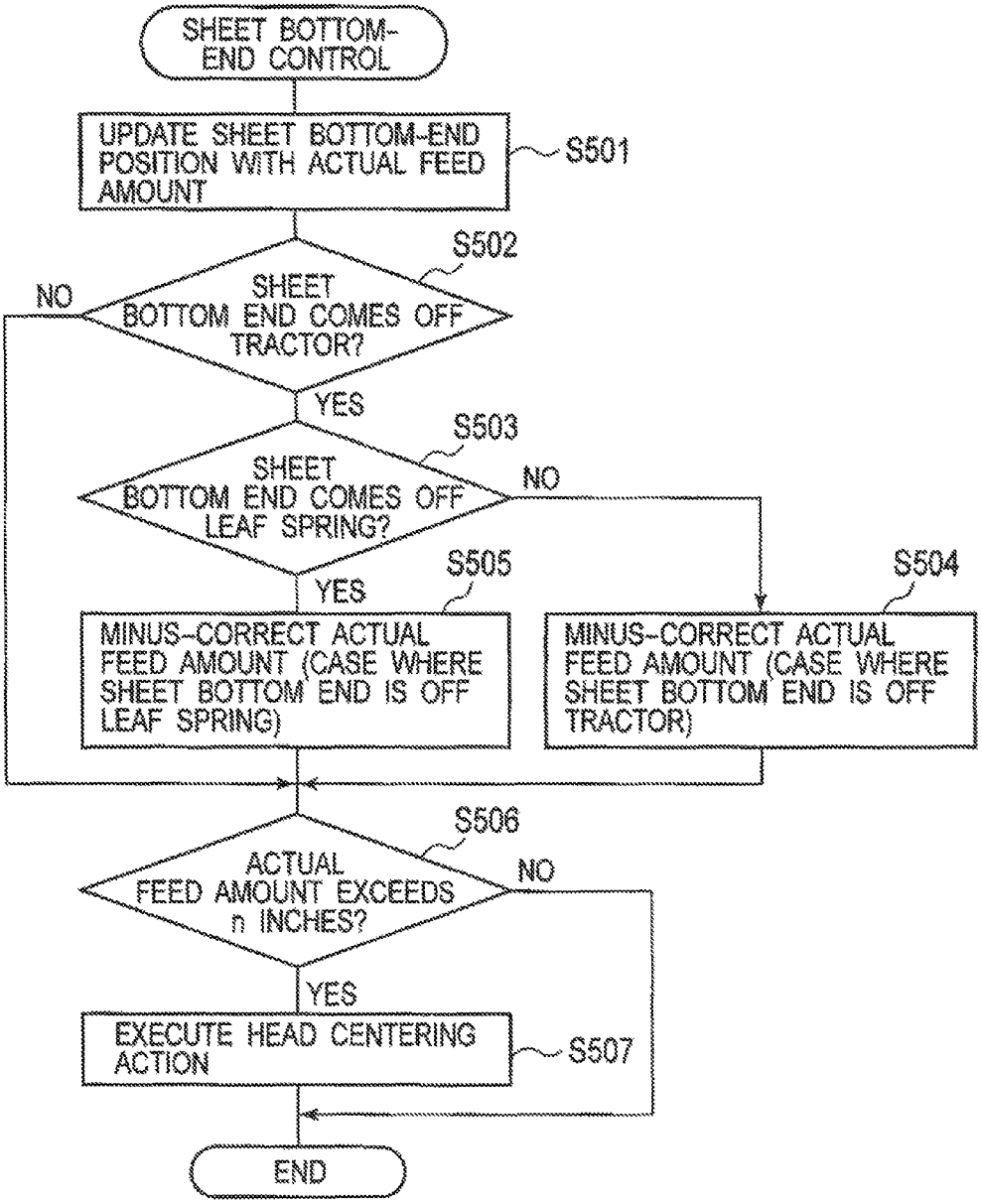
FIG. 13 is a flowchart illustrating sheet bottom-end control processing according to the second embodiment.

Next, sheet bottom-end control processing performed by feed controller 70 and feed-amount correction controller 71 shown in FIG. 1 are described with reference to FIGS. 1 and 10 by following steps represented by S in FIG. 13, which shows a flowchart illustrating the sheet bottom-end control processing according to the second embodiment.

S501: Feed controller 70 calculates the amount of sheet feeding to be actually executed, that is, the actual feed amount for the case where the sheet is sent out by rear push-tractor 17 after the top end of the sheet enters the contact portion of pull-up roller pair 151 in pull-up-roller assembly 15. Then, on the basis of the calculated actual feed amount and the vertical-current-position information, feed controller 70 calculates the position, in the sheet transportation direction, of the bottom end of the sheet after the execution of the feed action. Then, feed controller 70 uses the calculated position of the top end of the sheet to update the information of the sheet's bottom-end position stored in RAM 3.

S502: On the basis of the updated information on the position of the bottom end of the sheet, feed controller judges whether or not the bottom end of the sheet passes by the sheet-detection sensor and thus comes off the tractor (specifically, rear push-tractor 17 in the second embodiment). If feed controller 70 judges that the bottom end of the sheet comes off the tractor, the processing moves to S503. If, in contrast, feed controller 70 judges that the bottom end of the sheet does not come off the tractor, that is, if feed controller 70 judges that the transportation of the sheet can be performed by the tractor, the processing moves to S506.

S503: After judging that the bottom end of the sheet comes off the tractor, feed controller 70 judges whether or not the bottom end of the sheet comes off leaf spring 16, on the basis of the updated information on the position of the bottom end of the sheet. If feed controller judges that the bottom end of the sheet comes off leaf spring 16, the processing moves to S505. If, in contrast, feed controller judges that the bottom end of the sheet does not come off leaf spring 16, the processing moves to S504.

S504: Before the bottom end of the sheet comes off leaf spring 16, feed-amount correction controller 71 uses the feed-amount correction table shown in FIG. 14 and thereby corrects the actual feed amount calculated at S501 to obtain an optimal actual feed amount. Then, the processing moves to S506. Consequently, feed controller 70 makes pull-up roller pair 151 perform a feed action with the actual feed amount corrected as above.

S505: After the bottom end of the sheet comes off leaf spring 16, feed-amount correction controller 71 uses the feed-amount correction table shown in FIG. 15 and thereby corrects the actual feed amount calculated at S501 to obtain an optimal actual feed amount. Then, the processing moves to S506. Consequently, feed controller 70 makes pull-up roller pair 151 perform a feed action with the actual feed amount corrected as above.

Suppose a case where a feed action is performed by the pulling-up of the sheet by pull-up roller pair 151 in pull-up-roller assembly 15, and where the bottom end of the sheet is already off the tractor. In this case, the sheet actually moves by a feed amount larger than the feed amount in the case where the bottom end of the sheet is not off the tractor.

Accordingly, the actual feed amount is corrected in the following way. Firstly, the excess feed amount is extracted as a feed-correction amount from the feed-amount correction table shown in FIG. 14 or in FIG. 15. Then, the extracted feed-correction amount is subtracted from the actual feed amount calculated at S501. Incidentally, if a feed action is performed by the pulling-up of the sheet by pull-up roller pair 151 in pull-up-roller assembly 15, and, in addition, if the sheet is held by leaf spring 16, the resistance caused by the holding of the sheet by leaf spring 16 can reduce the feed amount from the feed amount needed in a case where the bottom end of the sheet is already off leaf spring 16.

Accordingly, if the sheet is held by leaf spring 16, the actual feed amount is corrected so that the corrected actual feed amount becomes larger than the actual feed amount of the case where the bottom end of the sheet is already off leaf spring 16. After the bottom end of the sheet comes off leaf spring 16, the sheet is fed only by the pulling-up of the sheet by pull-up roller pair 151. Hence, the feed amount is corrected by reducing the feed amount in a smaller unit so that the feed amount after the correction is prevented from being too large.

In practice, sheets of different thicknesses (e.g. copying paper, postcards, etc.) used in the printing move by different feed amounts. So, when the correction of the actual feed amount is performed, the currently-used sheet is identified on the basis of head-gap setup information and thereby the correction of the actual feed amount is made most suitable for the thickness of the sheet.

FIG. 14 shows a table of feed-amount correction before the bottom end of the sheet comes off leaf spring 16. For example, the head-gap setup information "1" corresponds to a feed-correction amount of "1/360 inches for every 0.3-inch feed." The head-gap setup information "2" corresponds to a feed-correction amount of "1/360 inches for every 0.275-inch feed." The head-gap setup information "3 and 4" corresponds to a feed-correction amount of "1/360 inches for every 0.25-inch feed." The head-gap setup information "5 to 8" corresponds to a feed-correction amount of "1/360 inches for every 0.225-inch feed." Each feed-correction amount is subtracted from the corresponding actual feed amount. The feed-correction amount is subtracted after the bottom end of the sheet is fed 25 mm away from the tractor until the bottom end of the sheet reaches leaf spring 16.

FIG. 15 shows a feed-amount correction table of the case where the bottom end of the sheet comes off leaf spring 16. For example, the head-gap setup information "1" corresponds to a feed-correction amount of "1/360 inches for every 0.25-inch feed." The head-gap setup information "2" corresponds to a feed-correction amount of "1/360 inches for every 0.2-inch feed." The head-gap setup information "3 and 4" corresponds to a feed-correction amount of "1/360 inches for every 0.175-inch feed." The head-gap setup information "5 to 8" corresponds to a feed-correction amount of "1/360 inches for every 0.15-inch feed." Each feed-correction amount is subtracted from the corresponding actual feed amount. The feed-correction amount is subtracted after the bottom end of the sheet comes off leaf spring 16 until the bottom end of the sheet reaches the contact portion of pull-up roller pair 151 in pull-up-roller assembly 15.

S506: Feed controller 70 judges whether or not the actual feed amount after the correction exceeds n inches (e.g., 1 inch). If feed controller judges that the actual feed amount after the correction exceeds n inches, the processing moves to S507. If feed controller judges that the actual feed amount after the correction does not exceed n inches, the processing is finished.

S507: Feed controller 70 notifies, via mechanical controller 40, space controller 50 of the fact that actual feed amount after the correction exceeds n inches. Then, space controller 50 executes a centering action to move print head 8 to the most suitable position for the feed action (e.g., to the center, in the horizontal direction, that print head 8 can be moved to). Then, the sheet bottom-end control processing is finished.

Figure 16:
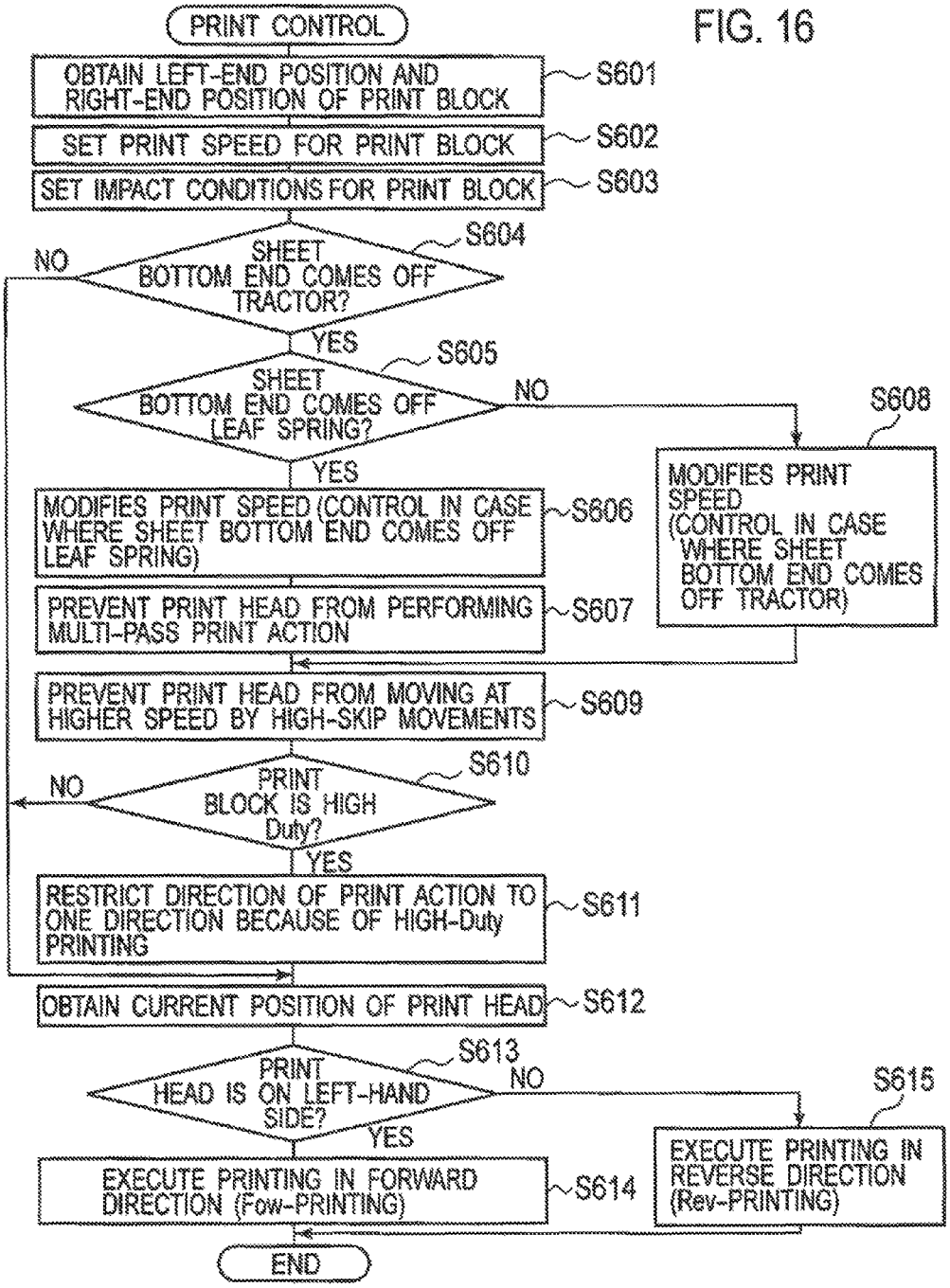
FIG. 16 is a flowchart illustrating print control processing according to the second embodiment.

Next, print control processing performed by space controller 50 and print controller 60 shown in FIG. 1 are described by referring to FIGS. 1 and 10 as well as by following 600-series steps in FIG. 16, which shows a flowchart illustrating the print control processing according to the second embodiment.

The print control processing of the second embodiment aim to prevent the degradation of the print quality, such as printing at incorrect positions in the bottom-end area of the sheet. After the bottom end of the sheet comes off rear push-tractor 17 or front push-tractor 18, the sheet is fed only by the pulling-up by pull-up roller pair 151 because rear push-tractor 17 or by front push-tractor 18 cannot perform any feed action by pushing-out. Hence, the unfixed bottom end of the sheet is moved by the movements of print head 8 during the print action, resulting in the degradation of the print quality such as printing at incorrect positions in the bottom-end area of the sheet.

The print control processing of the second embodiment reduces the degradation of the print quality in the following way. After the bottom end of the sheet comes off rear push-tractor 17 or front push-tractor 18, control is executed to reduce the print speed (the moving speed of print head 8) and/or to make the printing a one-way action (i.e., when actually executing the print action, print head 8 is allowed to move in one direction only) as in the first embodiment. Note that the print control processing to be described in the following paragraphs are the print control processing for only one line.

S601 to S603: The processes at S601 to S603 are similar to those at S301 to S303 shown in FIG. 8. So no description of those processes is given below. S604: On the basis of the current position of the bottom end of the sheet, print controller 60 judges whether or not the bottom end of the sheet passes by the sheet-detection sensor and thus comes off the tractor (specifically, rear push-tractor 17 in this second embodiment). If print controller 60 judges that the bottom end of the sheet comes off the tractor, the processing moves to S605. If, in contrast, print controller 60 judges that the bottom end of the sheet does not come off the tractor, that is, print controller 60 judges that the sheet can be transported by the tractor, the processing moves to S612.

S605: After judging that the bottom end of the sheet comes off the tractor, print controller 60 judges whether or not the bottom end of the sheet comes off leaf spring 16. Print controller 60 performs this judgment on the basis of the current position of the bottom end of the sheet. If print controller 60 judges that the bottom end of the sheet comes off leaf spring 16, the processing moves to S606. If, in contrast, print controller 60 judges that the bottom end of the sheet does not come off leaf spring 16, the processing moves to S608.

S606: After judging that bottom end of the sheet comes off leaf spring 16, print controller 60 prevents the sheet fixed only at the contact portion of pull-up roller pair 151 from being moved to an incorrect position by the movements of print head 8 during the print action in the following way. Print controller 60 extracts a print-speed reduction ratio from the print-speed reduction table stored in ROM 2, and then modifies (corrects) the print speed determined at S602. This print-speed reduction table is used to correct the print speed optimally for the sheets with various thicknesses. To this end, a judgment is performed to identify the thickness of the currently-used sheet on the basis of the head-gap setup information read out by head-gap detection sensor 11. Print controller 60 slows down and corrects the print speed determined at S602 on the basis of the print-speed reduction ratio. As FIG. 17A shows for example, if the head-gap setup information is "1," the print-speed reduction ratio of 75% is used. If the head-gap setup information is "2," the print-speed reduction ratio of 70% is used. If the head-gap setup information is "3 and 4," the print-speed reduction ratio of 60% is used. If the head-gap setup information is "5 to 8," the print-speed reduction ratio of 50% is used.

Different sheets (e.g. copying paper, postcards, etc.) used in the printing have different frictions and loads in the print direction. For this reason, in this print control processing, as in the correction of the actual feed amount by the sheet bottom-end control processing described earlier, the print speed is determined by identifying a print sheet for printing by using the head-gap setup information, by calculating the optimal print speed according to the thickness of the sheet, and by correcting (decreasing) the print speed appropriately. Accordingly, the movement of print head 8 during the printing causes smaller wobbles of the bottom end of the sheet in horizontal directions.

S607: Print controller 60 performs a setup to prevent print head 8 from performing a multi-pass print action. Then, the processing moves to S609. The multi-pass print action refers to an action of printing a line through plural times of movements of print head 8 in the horizontal direction. The multi-pass print action is employed mainly to make a clear copy in printing on copying paper or to make a print through plural times of passes in response to a print-modification setup for emphasized printing or the like. Note that the prevention of the multi-pass print action by this control is always employed unless correct print results cannot be obtained by performing multi-pass print actions.

S608: After judging that bottom end of the sheet does not come off leaf spring 16 in S605, print controller 60 prevents the sheet fixed at two positions from being moved to an incorrect position by the movements of print head 8 during the print action. The two positions are the contact portion of pull-up roller pair 151, and the contact portion of leaf spring 16 and platen 14. To achieve this prevention, print controller 60 extracts a print-speed reduction ratio from the print-speed reduction table stored in ROM 2, and then modifies (corrects) the print speed determined at S602. This print-speed reduction table is used to correct the print speed optimally for the sheets with various thicknesses. To this end, a judgment is performed to identify the thickness of the currently-used sheet on the basis of the head-gap setup information read out by head-gap detection sensor 11. Print controller 60 slows down and corrects the print speed determined at S602 on the basis of the print-speed reduction ratio. As FIG. 17B shows for example, if the head-gap setup information is "1," the print-speed reduction ratio of 75% is used. If the head-gap setup information is "2," the print-speed reduction ratio of 70% is used. If the head-gap setup information is "3 and 4," the print-speed reduction ratio of 60% is used. If the head-gap setup information is "5 to 8," the print-speed reduction ratio of 50% is used.

As has been described, before the bottom end of the sheet comes off leaf spring 16, the sheet is fixed at two positions: at the contact portion of pull-up roller pair 151; and at the contact portion of leaf spring 16 and platen 14. Accordingly, the print speed of the case where the bottom end of the sheet does not come off leaf spring 16 is made slightly faster than the print speed of the case where the bottom end of the sheet comes off leaf spring 16.

Different sheets (e.g. copying paper, postcards, etc.) used in the printing have different frictions and loads in the print direction. For this reason, in this print control processing, as in the correction of the actual feed amount by the sheet bottom-end control processing described earlier, the print speed is determined by identifying a print sheet for printing by using the head-gap setup information, by calculating the optimal print speed according to the thickness of the sheet, and by correcting (decreasing) the print speed appropriately. Accordingly, the movement of print head 8 during the printing causes smaller wobbles of the bottom end of the sheet in horizontal directions.

S609: As the bottom end of the sheet is off the tractor, space controller 50 performs control to prevent print head 8 from moving at a higher speed by high-skip movements at the time when no printing is actually made. The prevention of the faster movements of print head 8 aims to reduce as much as possible the wobbles of the top end of the sheet in the horizontal direction by the faster movements of print head 8 in the horizontal direction over the sheet. S610: Space controller 50 judges whether or not the next printing is high-duty printing with high print density of the print block. To put it differently, space controller 50 judges whether or not the print density of the print block exceeds a threshold value. If space controller 50 judges that the print density of the print block exceeds a threshold value, the processing moves to S611. If, in contrast, space controller 50 judges that the print density of the print block does not exceed a threshold value, the processing moves to S612.

S611: After judging that the next printing is high-duty printing, space controller 50 restricts the allowable direction of the print action to one direction only, that is, prevents the bi-directional printing. Thus, a reduction is achieved in the degree of misplacement of the sheet caused by the print action with the reciprocal movements of print head 8 in the horizontal directions. S612: print controller 60 obtains the current position of print head 8.

S613: On the basis of the current position of print head 8 as well as the left-end position and the right-end position of the print block obtained at S601, print controller 60 identifies the print direction that can minimize the time needed for the printing. If print controller 60 judges that the current position of print head 8 is located on the left-hand side or at the center of the print block to be printed next, the processing moves to S614. If, in contrast, print controller 60 judges that the current position of print head 8 is located on the right-hand side of the print block, the processing moves to S615.

S614: If print controller 60 judges that print head is currently at the left-hand side of the central position in the print block to be printed next or at the center of the print block, space controller 50 restricts the print direction to the forward direction only, and executes the printing (Fow-printing) from the left-hand side of the print block while print head 8 is moving in this direction. Then, space controller 50 finishes the print control processing. S615: If print controller 60 judges that print head 8 is currently at the right-hand side of the central position in the print block to be printed next, space controller 50 restricts the print direction to the reverse direction only, and executes the printing (Rev-printing) of the print block from the right-hand end while print head 8 is moving in this direction. Then, space controller 50 finishes the print control processing.

As has been described, after the bottom end of the sheet comes off the tractor, feed-amount correction controller 71 subtracts an appropriate correction value from the actual feed amount calculated on the basis of the received data, and thereby obtains an optimally-corrected actual feed amount. Hence, the misplacement by the stretched feed amount can be reduced. Accordingly, the sheet can be transported with higher precision and the print quality can be improved.

In addition, after the bottom end of the sheet comes off the tractor, print controller 60 corrects, by slowing down, the print speed determined on the basis of the received data. Hence, the wobbling of the sheet in the horizontal direction by the movements of print head 8 during the print action can be reduced. Accordingly, the sheet can be transported with higher precision and the print quality can be improved.

Furthermore, after the bottom end of the sheet comes off the tractor, space controller 50 prevents the faster movements of print head 8 by high-skip movements. Hence, the wobbling of the sheet in the horizontal direction by the faster movements of print head 8 can be reduced. Accordingly, the sheet can be transported with higher precision and the print quality can be improved.

As has been described, this second embodiment can obtain the following advantageous effects. After the bottom end of the sheet comes off the tractor, an appropriate correction value is subtracted from the actual feed amount calculated on the basis of the received data, and thereby an optimally-corrected actual feed amount is obtained. Hence, the misplacement by the stretched feed amount can be reduced. Accordingly, the sheet can be transported with higher precision and the print quality can be improved.

In addition, this second embodiment can also obtain the following advantageous effects. The print speed determined on the basis of the received data is corrected by slowing down the print speed thus determined. Hence, the wobbling of the sheet in the horizontal direction by the movements of the print head during the print action can be reduced. Accordingly, the sheet can be transported with higher precision and the print quality can be improved. Furthermore, this second embodiment can obtain the following advantageous effects as well. The faster movements of the print head by high-skip movements are prevented. Hence, the wobbling of the sheet in the horizontal direction can be reduced. Accordingly, the sheet can be transported with higher precision and the print quality can be improved.

Note that the description of the first embodiment assumes that the feed control and the print control are performed on the top end of the sheet whereas the description of the second embodiment assumes that the feed control and the print control are performed on the bottom end of the sheet. However, the control performed in the first embodiment may be combined with the control performed in the second embodiment, so that the feed control and the print control can be performed both on the top end and the bottom end of the sheet.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A print apparatus comprising:

a print-medium sender configured to transport a print medium to perform linefeed of the print medium;

a print-medium transportation unit disposed downstream of the print-medium sender in a print-medium transportation direction, and configured to transport the print medium to perform linefeed of the print medium;

a print unit disposed downstream of the print-medium sender and upstream of the print-medium transportation unit in the print-medium transportation direction, and configured to perform printing on the print medium while moving in a direction perpendicular to the print-medium transportation direction; and a linefeed-amount correction controller configured to set an amount of linefeed of the print medium by the print-medium sender to a first linefeed amount in order to linefeed the print medium by a first linefeed distance when only the print-medium sender transports the print medium, and to set an amount of linefeed of the print medium by the print-medium sender to a second linefeed amount different from the first linefeed amount in order to linefeed the print medium by the first linefeed distance when both the print-medium sender and the print-medium transportation unit transport the print medium at the same time, wherein a third linefeed amount, which is an amount of linefeed of the print-medium transportation unit when both the print-medium sender and the print-medium transportation unit transport the print medium, is greater than the second linefeed amount, which is the amount of linefeed of the print-medium sender when both the print-medium sender and the print-medium transportation unit transport the print medium.

2. The print apparatus according to claim 1, wherein the first linefeed amount is greater than the second linefeed amount.

3. The print apparatus according to claim 1 further comprising a print-unit movement controller configured to restrict the direction in which the print unit performs printing to a single direction when only one of the print-medium transportation unit and the print-medium sender linefeeds the print medium, and wherein the print-unit movement controller is configured to enable printing in two directions when both the print-medium transportation unit and the print-medium sending linefeed the print medium at the same time.

4. The print apparatus according to claim 2 further comprising a print-unit movement controller configured to restrict the direction in which the print unit performs printing to a single direction before the leading end of the print medium reaches the print-medium transportation unit.

5. The print apparatus according to claim 3, wherein the print-unit movement controller prevents the print unit from moving at a high speed when only one of the print-medium transportation unit and the print-medium sender linefeeds the print medium, and wherein the print-unit movement controller is configured to allow the print unit to move at the high speed when both the print-medium transportation unit and the print-medium sending linefeed the print medium at the same time.

6. The print apparatus according to claim 4, wherein the print-unit movement controller prevents the print unit from moving at a high speed before the leading end of the print medium reaches the print-medium transportation unit.

7. The print apparatus according to claim 1, wherein after a trailing end of the print medium comes off the print-medium sender, the linefeed-amount correction controller is configured to set the amount of linefeed of the print medium by the print-medium transportation unit to be smaller than the amount of linefeed before the trailing end of the print medium comes off the print-medium sender.

8. The print apparatus according to claim 1, wherein a third linefeed amount, which is an amount of linefeed of the print-medium transportation unit when both the print-medium sender and the print-medium transportation unit transport the print medium, is greater than a fourth linefeed amount, which is an amount of linefeed of the print-medium transportation unit when only the print-medium transportation unit transports the print medium.

9. The print apparatus according to claim 8, wherein after the trailing end of the print medium comes off the print-medium sender, the print-unit movement controller is configured to prevent the print unit from moving at a high speed.

10. The print apparatus according to claim 1, wherein after the trailing end of the print medium comes off the print-medium sender, the print-unit movement controller prevents the print unit from moving at a high speed.

11. The print apparatus according to claim 1, wherein the linefeed-amount correction controller is configured to correct the amount of linefeed of the print medium in accordance with a thickness of the print medium.

12. The print apparatus of claim 11, wherein the linefeed-amount correction controller is configured to correct the amount of linefeed of the print medium such that the linefeed amount is corrected in a greater amount as the thickness of the print medium increases in size.

13. The print apparatus according to claim 1, wherein the linefeed amount of the print medium is set by the linefeed-amount correction controller based in part on a distance between a platen and a print head provided along the print medium transportation direction after the print-medium sender and before the print-medium transportation unit.

14. A print apparatus comprising:

a print-medium sender configured to transport a print medium to perform linefeed of the print medium;

a print-medium transportation unit disposed downstream of the print-medium sender in a print-medium transportation direction, and configured to transport the print medium to perform linefeed of the print medium;

a print unit disposed downstream of the print-medium sender and upstream of the print-medium transportation unit in the print-medium transportation direction, and configured to perform printing on the print medium; and a controller configured to control an amount of linefeed of the print medium by the print-medium sender to a first linefeed amount in order to linefeed the print medium by a first linefeed distance when the print medium is transported by only the print-medium sender and to control an amount of linefeed of the print medium by the print medium sender to a second linefeed amount different from the first linefeed amount when both the print-medium sender and the print-medium transportation unit transport the print medium at the same time, wherein a third linefeed amount, which is an amount of linefeed of the print-medium transportation unit when both the print-medium sender and the print-medium transportation unit transport the print medium, is greater than a fourth linefeed amount, which is an amount of linefeed of the print-medium transportation unit when only the print-medium transportation unit transports the print medium.

15. The print apparatus according to claim 13, wherein the linefeed amount of the print medium is set by the linefeed-amount correction controller such that the linefeed amount of the print medium is corrected in a greater amount as the distance between the platen and the print head increases.

16. The print apparatus according to claim 14, wherein the first linefeed amount is greater than the second linefeed amount.

17. The print apparatus according to claim 14 further comprising a print-unit movement controller configured to restrict the direction in which the print unit performs printing to a single direction when only one of the print-medium transportation unit and the print-medium sender linefeeds the print medium, and wherein the print-unit movement controller is configured to enable printing in two directions when both the print-medium transportation unit and the print-medium sending linefeed the print medium at the same time.

18. The print apparatus according to claim 14, wherein the controller is configured to control the linefeed amount of the print medium in accordance with a thickness of the print medium.

19. The print apparatus of claim 18, wherein the controller is configured to control the linefeed amount of the print medium such that the linefeed amount is corrected in a greater amount as the thickness of the print medium increases in size.

20. The print apparatus according to claim 14, wherein the linefeed amount of the print medium is controlled by the controller based in part on a distance between a platen and a print head provided along the print medium transportation direction after the print-medium sender and before the print-medium transportation unit.

21. The print apparatus according to claim 20, wherein the linefeed amount of the print medium is controlled by the controller such that the linefeed amount of the print medium is corrected in a greater amount as the thickness of the print medium increases in size.

22. The print apparatus according to claim 14, wherein the controller is configured to move the print unit at a first speed when both the print-medium transportation unit and the print-medium sender linefeed the print medium at the same time, and the controller is configured to move the print unit at a second speed slower than the first speed when only one of the print-medium transportation unit and the print-medium sender linefeeds the print medium.

23. A print apparatus comprising:

a print-medium sender configured to transport a print medium to perform linefeed of the print medium;

a print-medium transportation unit disposed downstream of the print-medium sender in a print-medium transportation direction, and configured to transport the print medium to perform linefeed of the print medium;

a print unit disposed downstream of the print-medium sender and upstream of the print-medium transportation unit in the print-medium transportation direction, and configured to perform printing on the print medium; and a controller configured to control an amount of linefeed of the print medium by the print-medium sender to a first linefeed amount in order to linefeed the print medium by a first linefeed distance when the print medium is transported by only the print-medium sender and to control an amount of linefeed of the print medium by the print medium sender to a second linefeed amount different from the first linefeed amount when both the print-medium sender and the print-medium transportation unit transport the print medium at the same time, wherein a third linefeed amount, which is an amount of linefeed of the print-medium transportation unit when both the print-medium sender and the print-medium transportation unit transport the print medium, is greater than the second linefeed amount, which is the amount of linefeed of the print-medium sender when both the print-medium sender and the print-medium transportation unit transport the print medium.

* * * * *